United States Patent [19]

Atal

[11] Patent Number: 4,764,963

[45] Date of Patent: Aug. 16, 1988

[54] SPEECH PATTERN COMPRESSION ARRANGEMENT UTILIZING SPEECH EVENT IDENTIFICATION

[75] Inventor: Bishnu S. Atal, New Providence, N.J.

[73] Assignee: American Telephone and Telegraph Company, AT&T Bell Laboratories, Murray Hill, N.J.

[21] Appl. No.: 4,804

[22] Filed: Jan. 12, 1987

Related U.S. Application Data

[63] Continuation of Ser. No. 484,231, Apr. 12, 1983, abandoned.

[51] Int. Cl.[4] ..... G10L 5/00

[52] U.S. Cl. ..... 381/36

[58] Field of Search ..... 381/29–43

[56] References Cited

U.S. PATENT DOCUMENTS

| | | | |
|---|---|---|---|
| 3,598,921 | 8/1971 | Paine | 381/35 |
| 3,624,302 | 11/1971 | Atal | 179/1 SA |
| 3,641,496 | 2/1972 | Slavin | 381/51 |
| 3,803,358 | 4/1974 | Schirf et al. | 381/51 |
| 4,038,503 | 7/1977 | Moshier | 179/1 SA |
| 4,297,528 | 10/1981 | Beno | 381/45 |
| 4,349,700 | 9/1982 | Pirz et al. | 179/1 SD |

OTHER PUBLICATIONS

"An Efficient Linear-Prediction Vocoder", M. R. Sambur, *Bell System Technical Journal*, vol. 54, No. 10, Dec. 1975, *MC 68000 16-Bit Microprocessor User's Manual*, Motorola, Inc., 1980, (cover sheet).

*Primary Examiner*—Emanuel S. Kemeny

*Attorney, Agent, or Firm*—Jack S. Cubert; Wilford L. Wisner

[57] ABSTRACT

There are disclosed speech encoding methods and arrangements, including among others a speech synthesizer that reproduces speech from the encoded speech signals. These methods and arrangements employ a reduced bandwidth encoding of speech for which the bandwidth more nearly than in prior arrangements approaches that of the rate of occurrences of the individual sounds (equivalently, the articulatory movements) of the speech by locating the centroid of the individual sound, for example, by employing the zero crossing of a single (v(L)) representing the timing of individual sounds, which is derived from a $\phi$ signal which is itself produced from prescribed linear combination of acoustic feature signals, such as log area parameter signals. Each individual sound is encoded at a rate corresponding to its bandwidth. Accuracy is ensured by generating each individual sound signal from the linear combinations of acoustic feature signals for many times frames including the time frame of the centroid. The bandwidth reduction is associated with the spreading of the encoded signal over many time frames including the time frame of the centroid. The centroid of an individual sound is within a central time frame of an individual sound and occurs when the time-wise variations of the $\phi$ linear combination signal are most compressed.

11 Claims, 9 Drawing Sheets

SPEECH PATTERN COMPRESSION ARRANGEMENT UTILIZING SPEECH EVENT IDENTIFICATION

This application is a continuation of application Ser. No. 484,231, filed Apr. 12, 1983, now abandoned.

BACKGROUND OF THE INVENTION

My invention relates to speech processing and, more particularly, to compression of speech patterns.

It is generally accepted that a speech signal requires a bandwidth of at least 4 kHz for reasonable intelligibility. In digital speech processing systems such as speech synthesizers, recognizes, or coders, the channel capacity needed for transmission or memory required for storage of the digital elements of the full 4 kHz bandwidth waveform is very large. Many techniques have been devised to reduce the number of digital codes needed to represent a speech signal. Waveform coding such as PCM, DPCM, Delta Modulation or adaptive predictive coding result in natural sounding, high quality speech at bit rates between 16 and 64 kbps. The speech quality obtained from waveform coders, however, degrades as the bit rate is reduced below 16 kbps.

An alternative speech coding technique disclosed in U.S. Pat. No. 3,624,302 issued Nov. 30, 1971 to B. S. Atal and assigned to the same assignee utilizes a small number, e.g., 12–16, of slowly varying parameters which may be processed to produce a low distortion replica of a speech pattern. Such parameters, e.g., LPC or log area, generated by linear prediction analysis can be spectrum limited to 50 Hz without significant band limiting distortion. Encoding of the LPC or log area parameters generally requires sampling at a rate of twice the bandwidth and quantizing each resulting frame of LPC or log area parameters. Each frame of a log area parameter, for example, can be quantized using 48 bits. Consequently, 12 log area parameters each having a 50 Hz bandwidth results in a total bit rate of 4800 bits/sec.

Further reduction of bandwidth decreases the bit rate but the resulting increase in distortion, interferes with the intelligibility of speech synthesized from the lower bandwidth parameters. It is well known that sounds in speech patterns do not occur at a uniform rate and techniques have been devised to take into account such nonuniform occurrences. U.S. Pat. No. 4,349,700 issued Sept. 14, 1982 to L. R. Rabiner et al and assigned to the same assignee discloses arrangements that permit recognition of speech patterns having diverse sound patterns utilizing dynamic programming. U.S. Pat. No. 4,038,503 issued July 26, 1977 to Moshier discloses a technique for nonlinear warping of time intervals of speech patterns so that the sound features are represented in a more uniform manner. These arrangements, however, require storing and processing acoustic feature signals that are sampled at a rate corresponding to most rapidly changing feature in the pattern. It is an object of the invention to provide an improved speech representation arrangement having reduced digital storage and processing requirements.

SUMMARY OF THE INVENTION

Sounds or events in human speech are produced at an average rate that varies between 10 and 20 sounds or events per second. Acoustic features, however, are generated at a much higher rate which corresponds to the most rapidly changing features in the pattern, e.g., 50 Hz. It has been observed that such sounds or speech events, e.g., vowel sounds, generally occur at nonuniformly spaced time intervals and that articulatory movements differ widely for various speech sounds. Consequently, a significant degree of compression may be achieved by transforming acoustic feature parameters occurring at a uniform time frame rate, e.g., 50 Hz into short speech event related units representing articulatory movement in individual sounds occurring in the speech pattern located at nonuniformly spaced time intervals at the sound occurrence rate, e.g., 10 Hz. The coding of such speech event units results in higher efficiency i.e., substantially lower bit rate without degradation of the accuracy of the the pattern representation.

The invention is directed to speech encoding methods and arrangements adapted to convert signals representative of the acoustic features of the successive time frames of a speech pattern formed at the time frame rate to signals representative of the individual sounds (or equivalently, the articulatory movements producing those sounds) encoded at a lower rate which is their rate of occurrence. While the acoustic feature signals of the successive time frames are formed in a conventional way, the conversion to the lower rate signals comprises linearly combining selected ones of those acoustic feature signals and using those linear combinations for many successive time frames to locate the particular time frames in which occur the sound centroids, or more specifically the zero crossings of the timing signals described hereinafter. For each time frame so located, a signal is generated to represent the individual sound (or equivalently, the articulatory movement) having that centroid. In particular, that signal is generated from the aforesaid linear combinations of acoustic feature signals. Each individual sound signal is encoded at a rate corresponding to its bandwidth. Accuracy is ensured by generating each individual sound signal from the linear combinations of acoustic feature signals rather than the arbitrary smoothing techniques used in the prior art.

According to one aspect of the invention a speech pattern is synthesized by storing a prescribed set of speech element signals, combining said speech element signals to form a signal representative of the acoustic features of the uniform duration time frames of a speech pattern, and producing said speech pattern responsive to the set of acoustic feature signals. The prescribed speech element signals are formed by analyzing a speech pattern to generate a set of acoustic feature representative signals such as log area parameter signals at a first rate, e.g., 50 Hz. A sequence of signals representative of the articulatory movements of successive individual sounds in said speech pattern is produced responsive to said sampled acoustic feature signals at a second rate, e.g., 10 Hz and a sequence of digitally coded signals corresponding to the speech event representative signal is formed at the second rate less than said first rate.

GENERAL DESCRIPTION

Figure 1:
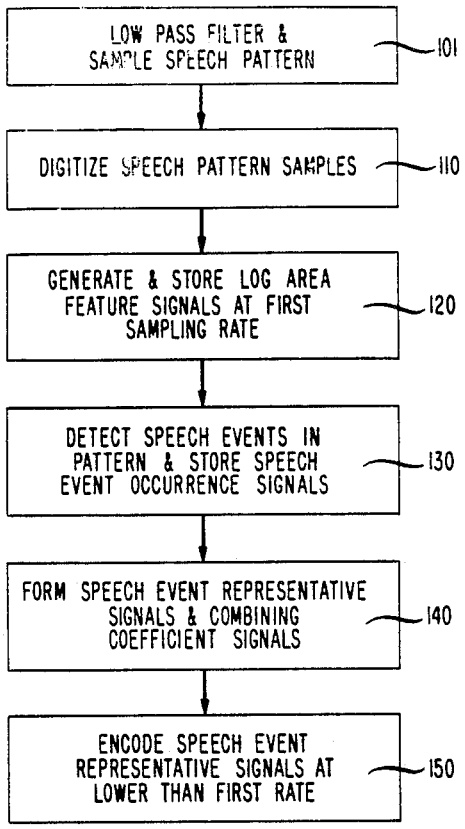
FIG. 1 depicts a flowchart illustrating the general method of the invention.

It is well known in the art to represent a speech pattern by a sequence of acoustic feature signals derived from a linear prediction or other spectral analysis. Log area parameter signals sampled at closely spaced time intervals have been used in speech synthesis to obtain efficient representation of a speech pattern. The closely spaced time intervals or time frames occurring at a uniform rate requires a bandwidth or bit rate sufficient to adequately represent the most rapid changes in the log area parameters of the speech pattern. Consequently, the number of bits per frame and the number of frames per second for coding the parameters are fixed to accommodate such rapid changes in the log area parameters. Alternatively, speech patterns have been represented in terms of their constituent sounds or speech events. As described in the article "Development of a Quantitative Description of Vowel Articulation" by Kenneth Stevens et al appearing in the *Journal of the Acoustical Society of America,* Vol. 27, No. 3, pp. 484–493, May 1955, and the article "An Electrical Analog of the Vocal Tract", by K. N. Stevens et al appearing in the *Journal of the Acoustical Society of America,* Vol. 25, No. 4, pp. 734–742, July 1953, each individual sound such as a vowel sound may be represented as a set of feature parameters corresponding to the articulatory configuration for the sound. The individual sounds or speech events in a speech pattern occur at a rate much lower than the time frame rate, and the bandwidth or bit rate requirements of such sounds are generally much lower than the bandwidth of the rapid changes in the log area or other linear predictive parameters. Other arrangements reduce the speech code bit rate by representing a succession of similar frames by the acoustic features of the first of the similar frames as disclosed in the article "Variable-to-Fixed Rate Conversion of Narrowband LPC Speech," by E. Blackman, R. Viswanathan, and J. Makhoul published in the *Proceedings of the* 1977 *IEEE International Conference on Acoustics, Speech, and Signal Processing,* pp. 409–412, and elsewhere. Unlike these other arrangements, the conversion of the sequence of time frame acoustic feature signals into a succession of individual sound articulatory configuration signals according to the invention provides reduced speech code bit rate by concentrating on coding the portions of speech, as described at pages 7 and 11, first paragraphs, containing centroids of signals representing individual sounds or more specifically, where a speech event signal is characterized by minimum spreading, i.e., is relatively compressed, rather than being approximations of the time frame acoustic features signals of the type described in the Blackman et al. reference. In accordance with the invention, log area parameters are transformed into a sequence of individual speech event feature signals $\phi_k(n)$ such that the log area parameters are related thereto in accordance with the relationship $$y_i(n) = \sum_{k=1}^{m} a_{ik}\phi_k(n) \qquad (1)$$

$$1 \leqq n \leqq N \; 1 \leqq i \leqq p$$

Figure 12:
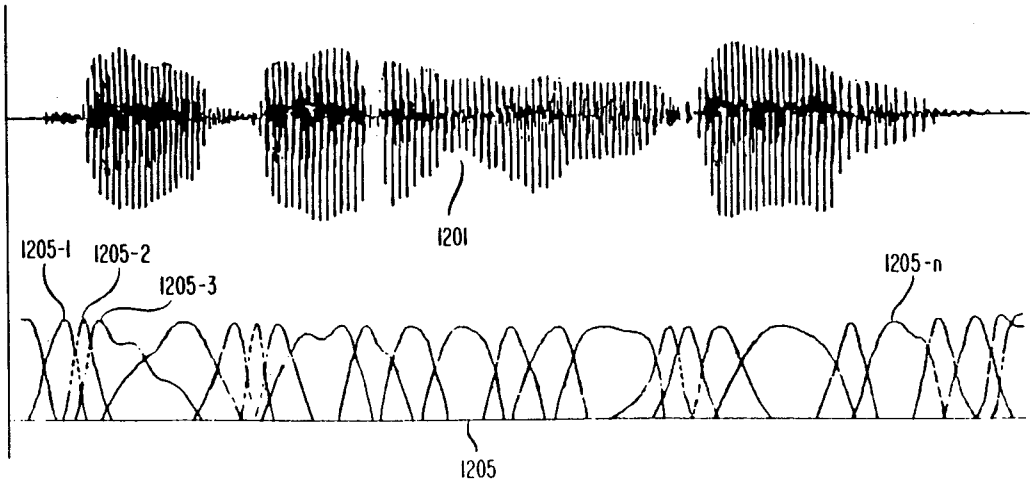
FIG. 12 shows waveforms illustrative of a speech pattern and the speech event feature signals associated therewith.

The speech event feature signals $\phi_k(n)$ illustrated in FIG. 12 are sequential and occur at the speech event rate of the pattern which is substantially lower than the the log area parameter frame rate. Log area parameters are well known in the art and are described in "Digital Processing of Speech Signals" by L. R. Rabiner and R. W. Schafer, Prentice Hall Signal Processing Series, 1978, pp. 444 and elsewhere. In equation (1), each speech event signal $\phi_k(n)$ corresponds to the features of the articulatory configuration of an individual sound occurring in the speech pattern, and p is the total number of log area parameters $y_i(n)$ determined by linear prediction analysis. m corresponds to the number of speech events in the pattern, n is the index of samples in the speech pattern at the sampling rate of the log area parameters, $\phi_k(n)$ is the kth speech event signal at sampling instant n, and $a_{ik}$ is a combining coefficient corresponding to the contribution of the kth speech event function to the ith log area parameter. Equation (1) may be expressed in matrix form as $$Y = A\Phi \qquad (2)$$

where Y is a pxN matrix whose (i, n) element is $y_i(n)$, A is a pxm matrix whose (i, k) element is $a_{ik}$, and $\Phi$ is an mxN matrix whose (k, n) element is $\phi_k(n)$. Since each speech event k occupies only a small segment of the speech pattern, the signal $\phi_k(n)$ representative thereof should be non-zero over only a small range of the sampling intervals of the total pattern. Each log area parameter $y_i(n)$ in equation (1) is a linear combination of the speech event functions $\phi_k(n)$ and the bandwidth of each $y_i(n)$ parameter is the maximum bandwidth of any one of the speech event functions $\phi_k(n)$. It is therefore readily seen that the direct coding of $y_i(n)$ signals will take more bits than the coding of the $\phi_k(n)$ sound or switch event signals and the combining coefficient signals $a_{ik}$ in equation (1).

FIG. 1 shows a flow chart illustrative of the general method of the invention. In accordance with the invention, a speech pattern is analyzed to form a sequence of signals representative of log area parameter acoustic feature signals. It is to be understood, however, that LPC, PARCOR or other speech features may be used instead of log area parameters and that log area parameter signals may be formed from LPC or the other speech features as is well known in the art. The instructions for the conversion of LPC to log area parameters are listed in Appendix A hereto in Fortran Language. The feature signals are then converted into a set of speech event or individual sound representative signals that are encoded at a lower bit rate for transmission or storage.

With reference to FIG. 1, box 101 is entered in which an electrical signal corresponding to a speech pattern is low pass filtered to remove unwanted higher frequency noise and speech components and the filtered signal is sampled at twice the low pass filtering cutoff frequency. The speech pattern samples are then converted into a sequence of digitally coded signals corresponding to the pattern as per box 110. Since the storage required for the sample signals is too large for most practical applications, they are utilized to generate log area parameter signals as per box 120 by linear prediction techniques well known in the art. The log area parameter signals $y_i(n)$ are produced at a constant sampling rate high enough to accurately represent the fastest expected event in the speech pattern. Typically, a sampling interval between two and five milliseconds is selected.

After the log area parameter signals are stored, the times of occurrence of the successive speech events, i.e., individual sounds, in the pattern are detected and signals representativve of the event timing are generated and stored as per box 130. This is done by partitioning the pattern into prescribed smaller segments, e.g., 0.25 second intervals. For each successive interval having a beginning frame $n_b$ and an ending frame $n_e$, a matrix of log area parameter signals is formed corresponding to the log area parameters $y_i(n)$ of the segment. The redundancy in the matrix is reduced by factoring out the first four principal components so that each log area parameter signal of a time frame n is represented as $$y_i(n) = \sum_{m=1}^{4} [c_{im}u_m(n)] \tag{3}$$

and conversely, the principal components $u_m(n)$ of the time frame is determined from the log area parameters of the frame as $$u_m(n) = \sum_{i=1}^{P} [\beta_{im}y_i(n)] \tag{4}$$

The first four principal components may be obtained by methods well known in the art such as described in the article "An Efficient Linear Prediction Vocoder" by M. R. Sambur appearing in the Bell System Technical Journal Vol. 54, No. 10, pp. 1693–1723, December 1975. The resulting $u_m(n)$ functions may be linearly combined to define the desired speech event signals representing the articulatory features of individual sounds as $$\phi_k(n) = \sum_{m=1}^{4} [b_{km}u_m(n)] \tag{5}$$

by selecting coefficients $b_{km}$ such that each $\phi_k(n)$ are most compact in time. In this way, the speech pattern is represented by a sequence of successive compact (minimum spreading) speech event feature signals $\phi_k(n)$ each of which can be efficiently coded. In order to obtain the shapes and locations of the speech event signals, a distance measure $$\theta(L) = \left[ \sum_n (n - L)^2\phi^2(n) / \sum_n \phi^2(n) \right]^{\frac{1}{2}} \tag{6}$$

is minimized to choose the optimum $\phi(n)$ and its location is obtained from a speech event timing signal $$v(L) = \left[ \sum_n (n - L)\phi^2(n) \right] / \sum_n \phi^2(n) \tag{7}$$

In terms of equations 5, 6, and 7, a speech event signal $\phi_k(n)$ with minimum spreading is centered at each negative zero crossing of v(L).

Subsequent to the generation of the v(L) signals in box 130, box 140 is entered and the speech event signals $\phi_k(n)$ are accurately determined using the process of box 130 with the speech event occurrence signals from the negative going zero crossings of v(L). Having generated the sequence of speech event representative signals, the combining coefficients $a_{ik}$ in equations (1) and (2) may be generated by minimizing the mean-squared error between each log area parameter signal $y_i(n)$ and the same log area parameter signal constructed from the individual sound features applicable to time frame n $$E = \sum_n \left[ y_i(n) - \sum_{k=1}^{M} a_{ik}\phi_k(n) \right]^2 \tag{8}$$

where M is the total number of speech events within the range of index n over which the sum is performed. The partial derivatives of E with respect to the coefficients $a_{ik}$ are set equal to zero and the coefficients $a_{ik}$ that minimize the mean square error E are obtained from the set of simultaneous linear equations $$\sum_{k=1}^{M} a_{ik} \sum_n \phi_k(n)\phi_r(n) = \sum_n y_i(n)\phi_r(n) \tag{9}$$

$$1 \leqq r \leqq M$$

$$1 \leqq i \leqq P$$

DETAILED DESCRIPTION

Figure 2:
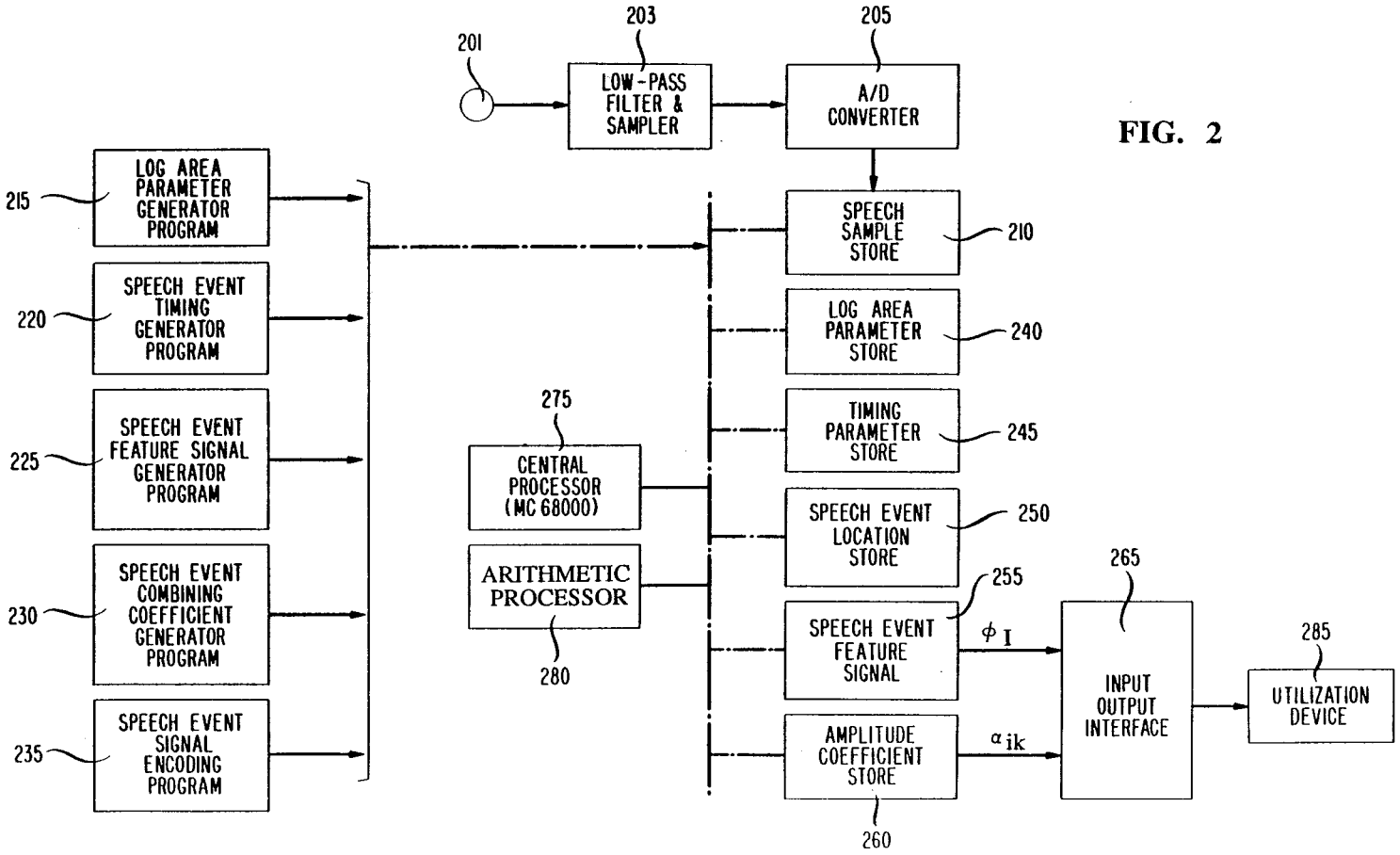
FIG. 2 depicts a block diagram of a speech pattern coding circuit illustrative of the invention.

FIG. 2 shows a speech coding arrangement that includes electroacoustic transducer 201, filter and sampler circuit 203, analog to digital converter 205, and speech sample store 210 which cooperate to convert a speech pattern into a stored sequence of digital codes representative of the pattern. Central processor 275 may comprise a microprocessor such as the Motorola type MC68000 controlled by permanently stored instructions in read only memories (ROM) 215, 220, 225, 230 and 235. Processor 275 is adapted to direct the operations of arithmetic processor 280, and stores 210, 240, 245, 250, 255 and 260 so that the digital codes from store 210 are compressed into a compact set of speech event feature signals. The speech event feature signals are then supplied to utilization device 285 via input output interface 265. The utilization device may be a digital communication facility or a storage arrangement for delayed transmission or a store associated with a speech synthesizer. The Motorola MC68000 integrated circuit is described in the publication MC68000 16 *Bit Microprocessor User's Manual,* second edition, Motorola, Inc., 1980 and arithmetic processor 280 may comprise the TRW type MPY-16HJ integrated circuit.

Referring to FIG. 2, a speech pattern is applied to electroacoustic transducer 201 and the electrical signal therefrom is supplied to low pass filter and sampler circuit 203 which is operative to limit the upper end of the signal bandwidth to 3.5 KHz and to sample the filtered signal at an 8 KHz rate. Analog to digital converter 205 converts the sampled signal from filter and sampler 203 into a sequence of digital codes, each representative of the magnitude of a signal sample. The resulting digital codes are sequentially stored in speech sample store 210.

Subsequent to the storage of the sampled-speech pattern codes in store 210, central processor 275 causes the instructions stored in log area parameter program store 215 to be transferred to the random access memory associated with the central processor. The flow chart of FIG. 3 illustrates the sequence of operations performed by the controller responsive to the instructions from store 215 and the instruction sequence is listed in FORTRAN language form in Appendix A.

Figure 3:
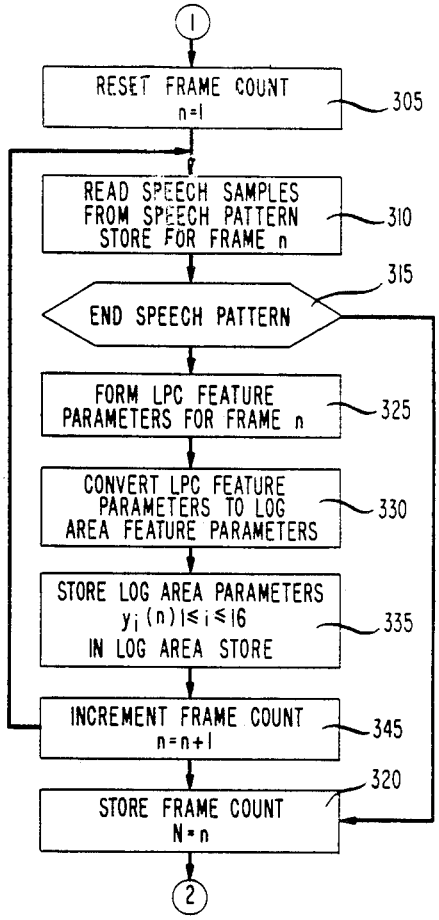
FIGS. 3–8 depict detailed flowcharts illustrating the operation of the circuit of FIG. 2.

Referring to FIG. 3, box 305 is initially entered and frame count index n is reset to 1. The speech samples of the current frame are then transferred from store 210 to arithmetic processor 280 via central processor 275 under as per box 310. The occurrence of an end of speech sample signal is checked in decision box 315. Until the detection of the end of speech pattern signal, control is passed to box 325 and an LPC analysis is performed for the frame in processors 275 and 280. The LPC parameter signals of the current frame are then converted to log area parameter signals $y_i(k)$ as per box 330 and the log area parameter signals are stored in log area parameter store 240 (box 335). The frame count is incremented by one in box 345 and the speech samples of the next frame are read (box 310). When the end of speech pattern signal occurs, control is passed to box 320 and a signal corresponding to the number of frames in the pattern is stored in processor 275.

Central processor 275 is operative after the log area parameter storing operation is completed to transfer the stored instructions of ROM 220 into its random access memory. The instruction codes from store 220 correspond to the operations illustrated in the flow chart of FIGS. 4 and 5 and are listed in FORTRAN Language form in Appendix B. These instruction codes are effective to generate a signal v(L) from which the occurrences of the speech events in the speech pattern may be detected and located.

Figure 4:
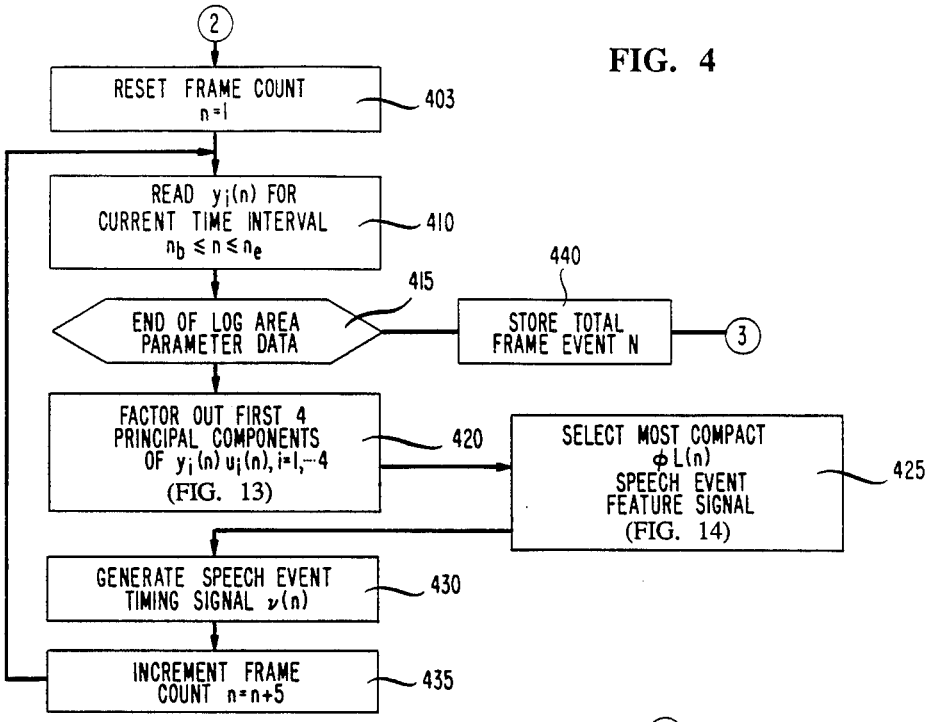
Figure 13:
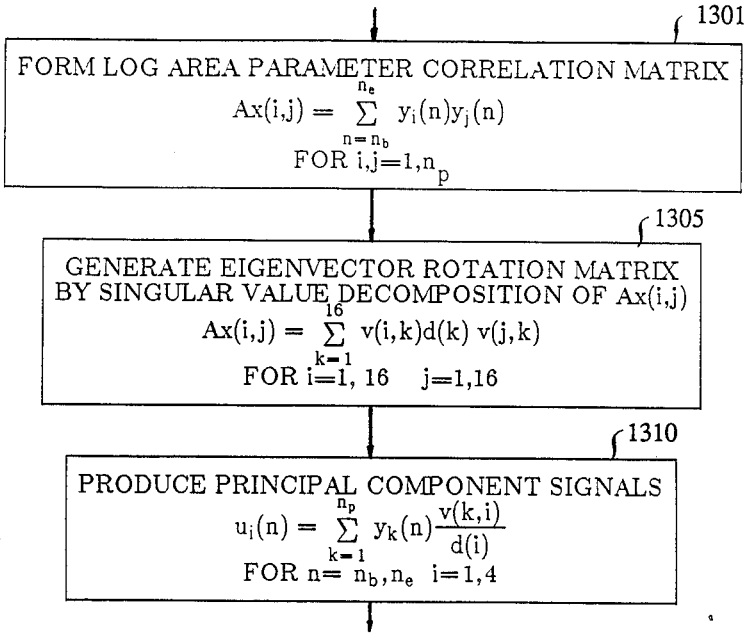
FIGS. 13 and 14 show the principal component factoring and speech event feature signal selection operations of FIG. 4 in greater detail.

Referring to FIG. 4, the frame count of the log area parameters is initially reset in processor 275 as per box 403 and the log area parameters $y_i(n)$ for an initial time interval $n_1$ to $n_2$ of the speech pattern are transferred from log area parameter store 240 to processor 275 (box 410). After determining whether the end of the speech pattern has been reached in decision box 415, box 420 is entered and the redundancy of the log area parameter signals is removed by factoring out the first four principal components $u_i(n)$, $i=1, \ldots, 4$ as aforementioned. The principal component factoring operations of box 420 are shown in greater detail in FIG. 13. Referring to FIG. 13, a log area parameter correlation matrix Ax(i,j) is formed for i and j ranging from 1 to np (box 1301), an eigenvector rotation matrix is generated by singular value decomposition of matrix Ax(i,j) for i and j ranging from 1 to 16 (box 1305), and the principal component signals $u_i(n)$ are formed over the interval from $n_b$ to $n_e$ for $i=1, 2, 3, 4$ from the log area parameter signals and the results of the eigenvector rotation matrix (box 1310).

Figure 14:
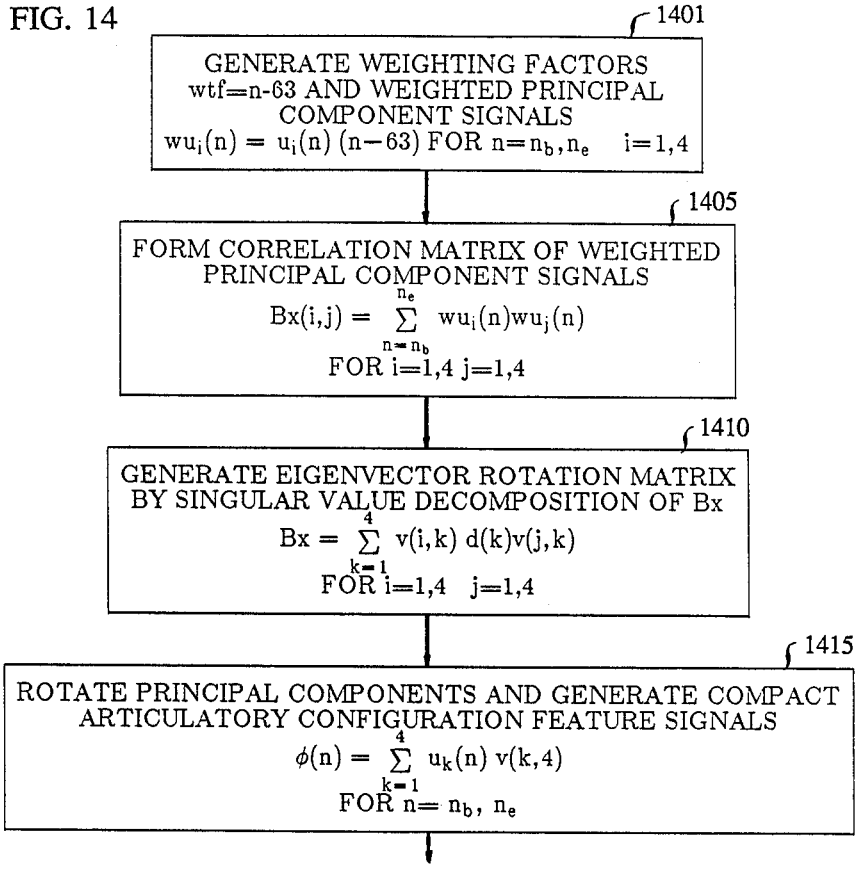

The log area parameters of the current time interval are then represented by $$y_i(n) = \sum_{m=1}^{4} c_{im} u_m(n) \tag{10}$$

from which a set of signals $$u_m(n) = \sum_{i=1}^{16} \beta_{im} y_i(n) \tag{11}$$

are to be obtained. The $u_i(n)$ signals over the interval may be combined through use of parameters $b_i$, $i=1, \ldots, 4$, in box 425 so that a set of signals $$\phi_k(n) = \sum_{m=1}^{4} [b_{km} u_m(n)] \tag{12}$$

is produced such that $\phi_k$ is most compact over the range $n_1$ to $n_2$. This is accomplished through use of the $\theta(L)$ function of equation 6. The combining of the $u_i(n)$ signals of box 425 is shown in greater detail in FIG. 14 in which the principal component signals $u_i(n)$ from box 420 are weighted to form signals $wu_i(n)=u_i(n)(n-63)$ in box 1401. A correlation matrix of the weighted principal component signals Bx(i,j) is generated for i and j ranging from 1 to 4 (box 1405) and an eigenvector rotation matrix is generated by singular value decomposition of correlation matrix Bx(i,j) for i and j ranging from 1 to 4 (box 1410). The principal component signals $u_k(n)$ are combined with the results of the eigenvector rotation matrix of box 1410 for n ranging from $n_b$ to $n_e$ in box 1415 to form the articulatory configuration signals which are the speech event signals of box 425 of FIG. 4. A signal v(L) representative of the speech event timing of the speech pattern is then formed in accordance with equation 7 in box 430 and the v(L) signal is stored in timing parameter store 245. Frame counter n is incremented by a constant value, e.g., 5, on the basis of how close adjacent speech event signals $\phi_k(n)$ are expected to occur (box 435) and box 410 is reentered to generate the $\phi_k(n)$ and v(L) signals for the next time interval of the speech pattern.

Figure 11:
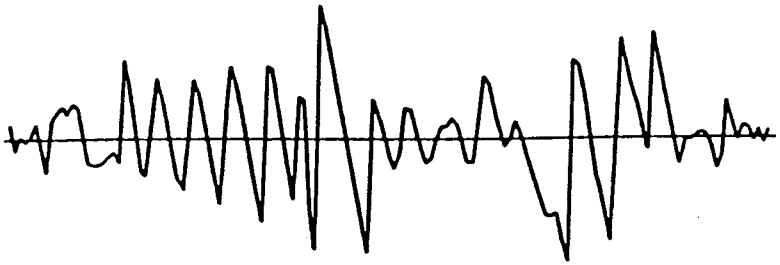
FIG. 11 shows a waveform illustrating a speech event timing signal obtained in the circuit of FIG. 2.

When the end of the speech pattern is detected in decision box 415, the frame count of the speech pattern is stored (box 440) and the generation of the speech event timing parameter signal for the speech pattern is completed. FIG. 11 illustrates the speech event timing parameter signal for the an utterance exemplary message. Each negative going zero crossing in FIG. 11 corresponds to the centroid of a speech event feature signal $\phi_k(n)$.

Figure 5:
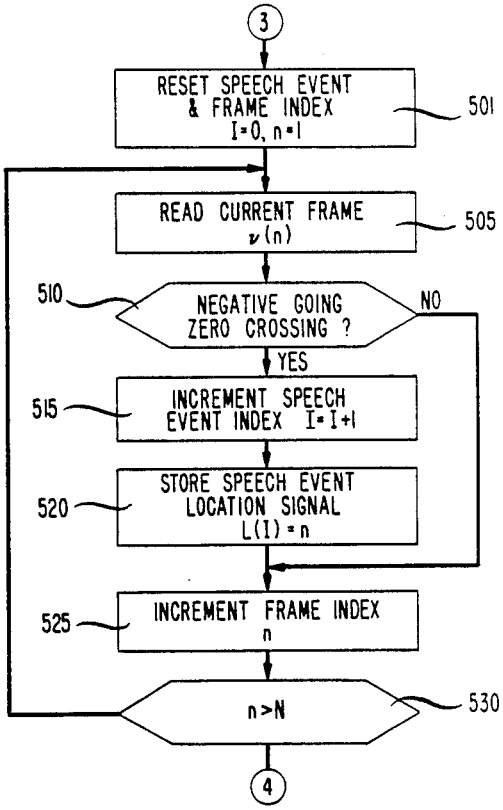

Referring to FIG. 5, box 501 is entered in which speech event index I is reset to zero and frame index n is again reset to one. After indices I and n are initialized, the successive frames of speech event timing parameter signal are read from store 245 (box 505) and zero crossings therein are detected in processor 275 as per box 510. Whenever a zero crossing is found, the speech event index I is incremented (box 515) and the speech event location frame is stored in speech event location store 250 (box 520). The frame index n is then incremented in box 525 and a check is made for the end of the speech pattern frames in box 530. Until the end of speech pattern frames signal is detected, box 505 is reentered from box 530 after each iteration to detect the subsequent speech event location frames of the pattern.

Upon detection of end of the speech pattern signal in box 530, central processor 275 addresses speech event feature signal generation program store 225 and causes its contents to be transferred to the processor. Central processor 275 and arithmetic processor 280 are thereby adapted to form a sequence of speech event feature signals $\phi_k(n)$ responsive to the log area parameter signals in store 240 and the speech event location signals in store 250. The speech event feature signal generation program instructions listed in FORTRAN Language in Appendix C hereto are illustrated in the flow chart of FIG. 6.

Figure 15:
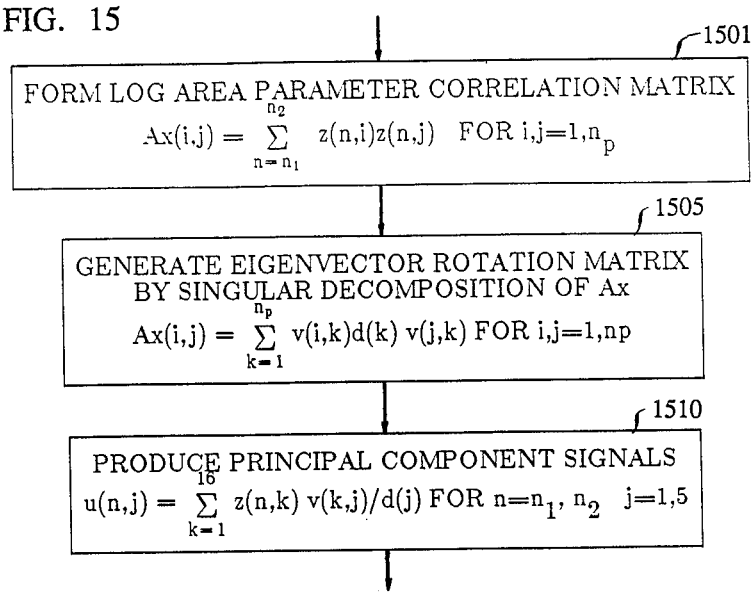
FIGS. 15 and 16 show the principal component factoring and the feature signal generation operations of FIG. 6 in greater detail.

Initially, location index I is set to one as per box 601 and the locations of the speech events in store 250 are transferred to central processor 275 (box 605). As per box 610, the limit frames for a prescribed number of speech event locations, e.g., 5, are determined. The log area parameters for the speech pattern interval defined by the limit frames are read from store 240 and are placed in a section of the memory of central processor 275 (box 615). The redundancy in the log area parameters is removed by factoring out the number of principal components therein corresponding to the number of prescribed number of events (box 620). FIG. 15 shows the factoring out of the 5 principal component signals in greater detail. In FIG. 15, a log area parameter correlation matrix Ax(i,j) is formed from the log area parameter signals for i and j ranging from 1 to np (box 1501), and an eigenvector rotation matrix is generated by singular value decomposition of matrix Ax (box 1505), and the 5 principal component signals u(n,j) are produced from the log area parameter signals and the results of the eigenvector rotation matrix (box 1510). Immediately thereafter, the speech event feature signal $\phi_L(n)$ for the current location L is generated.

As aforementioned, the distance signal $\theta(L)$ of equation 6 is minimized to determine the optimum $\phi(n)$ signal and to find the time frame in which it is centered. The minimization of equation (6) to determine $\phi_L(n)$ is accomplished by forming the derivative $$\frac{\partial \ln\theta(L)}{\partial b_r} = \tag{13}$$

$$\frac{1}{2}\,2\left[\sum_{n=n_1}^{n_2}(n-L)^2\phi(n)\frac{\partial\phi(n)}{\partial b_r} \Big/ \sum_{n=n_1}^{n_2}(n-L)^2\phi^2(n)\right]$$

where $$\phi(n) = \sum_{i=1}^{m} b_i u_i(n) \tag{14}$$

m is preset to the prescribed number of speech events, i.e., individual sounds, and r can be either 1, 2, . . . , or m. The derivative of equation (13) is set equal to zero to determine the minimum and $$\sum_{n=n_1}^{n_2}(n-L)^2\phi(n)\frac{\partial\phi(n)}{\partial b_r} \Big/ \sum_{n=n_1}^{n_2}(n-L)^2\phi^2(n) \tag{15}$$

$$= \sum_{n=n_1}^{n_2}\phi(n)\frac{\partial\phi(n)}{\partial b_r} \Big/ \sum_{n=n_1}^{n_2}\phi^2(n)$$

is obtained. From equation (14)

$$\frac{\partial\phi(n)}{\partial b_r} = u_r(n) \tag{16}$$

so that equation (15) can be changed to $$\sum_{n=n_1}^{n_2}(n-L)^2\phi(n)u_r(n) \tag{17}$$

$$= \left[\sum_{n=n_1}^{n_2}(n-L)^2\phi^2(n) \Big/ \sum_{n=1}^{n_2}\phi^2(n)\right]\left[\sum_{n=n_1}^{n_2}\phi(n)u_r(n)\right]$$

$\phi(n)$ in equation (17) can be replaced by the right side of equation 14. Thus, $$\sum_{n=n_1}^{n_2}(n-L)^2\sum_{i=1}^{M} b_i u_i(n)u_r(n) \tag{18}$$

$$= \lambda\left[\sum_{n=1}^{N}\sum_{i=1}^{M} b_i u_i(n)u_r(n)\right]$$

where $$\lambda = \sum_{n=n_1}^{n_2}(n-L)^2\phi^2(n) \Big/ \sum_{n=n_1}^{n_2}\phi^2(n) = \text{min. value } \theta(L) \tag{19}$$

Rearranging equation (18) yields $$\sum_{i=1}^{M} b_i \sum_{n=n_1}^{n_2}(n-L)^2 u_i(n)u_r(n) \tag{20}$$

$$= \theta(L)\sum_{i=1}^{M} b_i \sum_{n=n_1}^{n_2} u_i(n)u_r(n)$$

Since $u_i(n)$ is the principal component of matrix Y, $$\sum_{n=n_1}^{n_2} u_i(n)u_r(n) \begin{array}{ll} = 0 & i \neq r \\ = 1 & i = r \end{array} \tag{21}$$

equation (20) can be simplified to $$\sum_{i=1}^{M} b_i R_{ir} = b_r\theta(L) \tag{22}$$

where $$R_{ir} = \sum_{n=n_1}^{n_2}(n-L)^2 u_i(n)u_r(n) \tag{23}$$

Equation (22) can be expressed in matrix notation as $$Rb = \lambda b \tag{24}$$

where $$\lambda = \theta(L) \tag{25}$$

Equation 25 has exactly m solutions and the solution which minimizes $\theta(L)$ is the one for which $\lambda$ is minimum. The coefficients $b_1, b_2, \ldots, b_m$ for which $\lambda = \theta(L)$ attains its minimum value results in the optimum speech event feature signal $\phi_L(n)$. The optimum speech event feature signal corresponds to a controlled time spreading function having its centroid at the detected time of occurrence formed in accordance with the instructions set forth in Appendix C.

Figure 6:
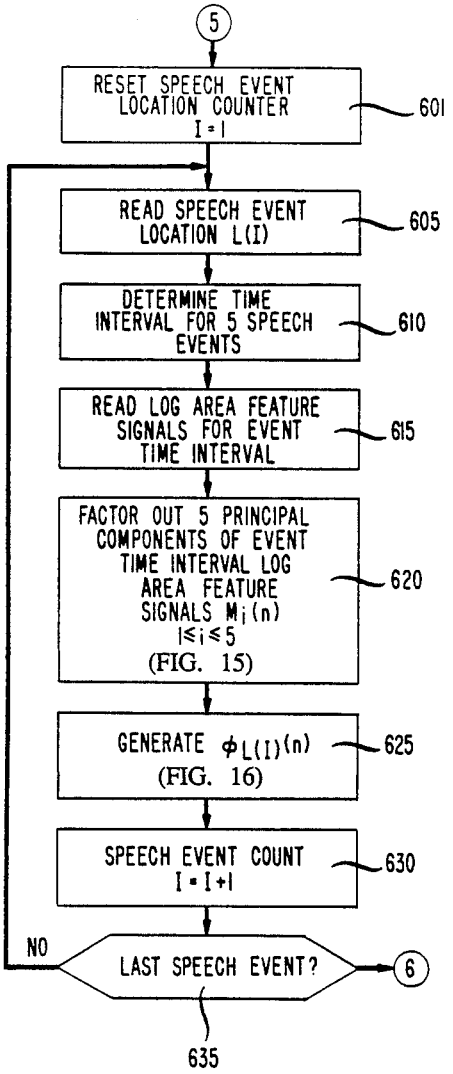
Figure 16:
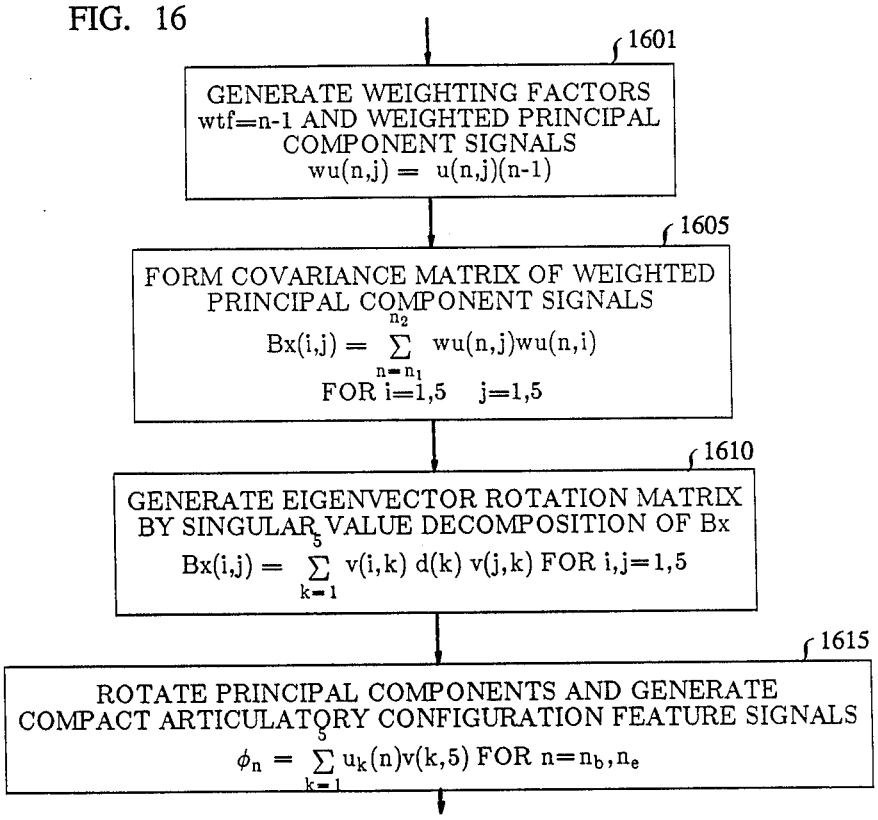

In FIG. 6, the speech event feature signal $\phi_L(n)$ is generated in box 625 and is stored in store 255. The forming of signal $\phi(n)$ of box 625 is shown in greater detail in FIG. 16 wherein the principal component signals $u_i(n)$ from box 620 are weighted to form signals $wu_i(n)=u_i(n)(n-1)$ in box 1601. A correlation matrix of the weighted principal component signals Bx(i,j) is generated for i and j ranging from 1 to 5 (box 1605) and an eigenvector rotation matrix is generated by singular value decomposition of correlation matrix Bx(i,j) for i and j ranging from 1 to 5 (box 1610). The principal component signals $u_k(n)$ are combined with the results of the eigenvector rotation matrix of box 1610 for n ranging from $n_b$ to $n_e$ in box 1615 to form $\phi(n)$ signals of box 625 of FIG. 6. Until the end of the speech pattern is detected in decision box 635, the loop including boxes 605, 610, 615, 620, 625 and 630 is iterated so that the complete sequence of speech events for the speech pattern is formed.

FIG. 12 shows waveforms illustrating a speech pattern and the speech event feature signals generated therefrom in accordance with the invention. As aforementioned, the speech event feature signals correspond to the articulatory configurations of individual sounds in the speech pattern. Waveform 1201 corresponds to a portion of a speech pattern and waveforms 1205-1 through 1205-n correspond to the sequence of speech event feature signals $\phi_L(n)$ obtained from the speech pattern waveform 1201 in the circuit of FIG. 2. Each feature signal is representative of the characteristics of a speech event, i.e., individual sound, of the pattern of waveform 1201. The speech event feature signals may be combined with coefficients $a_{ik}$ of equation 1 to reform log area parameter signals that are representative of the acoustic features of the speech pattern.

Upon completion of the operations shown in FIG. 6, the sequence of speech event feature signals for the speech pattern is stored in store 255. Each speech event feature signal $\phi_I(n)$ is encoded and transferred to utilization device 285 as illustrated in the flow chart of FIG. 7. Central processor 275 is adapted to receive the speech event signal encoding program instruction set stored in ROM 235. These instruction codes are listed in Fortran language form in Appendix D.

Figure 7:
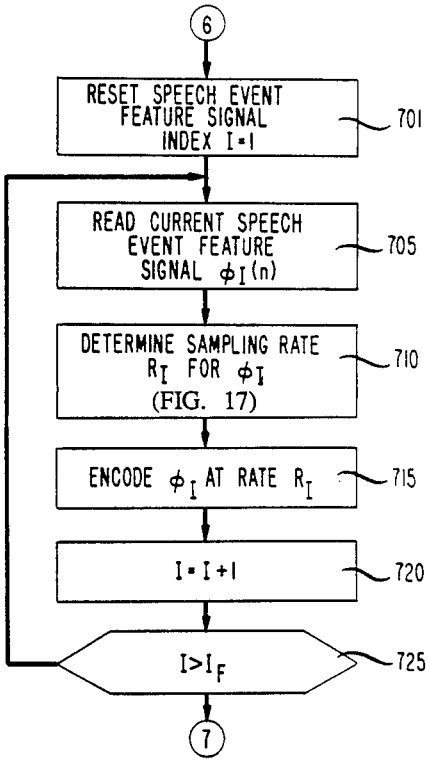
Figure 17:
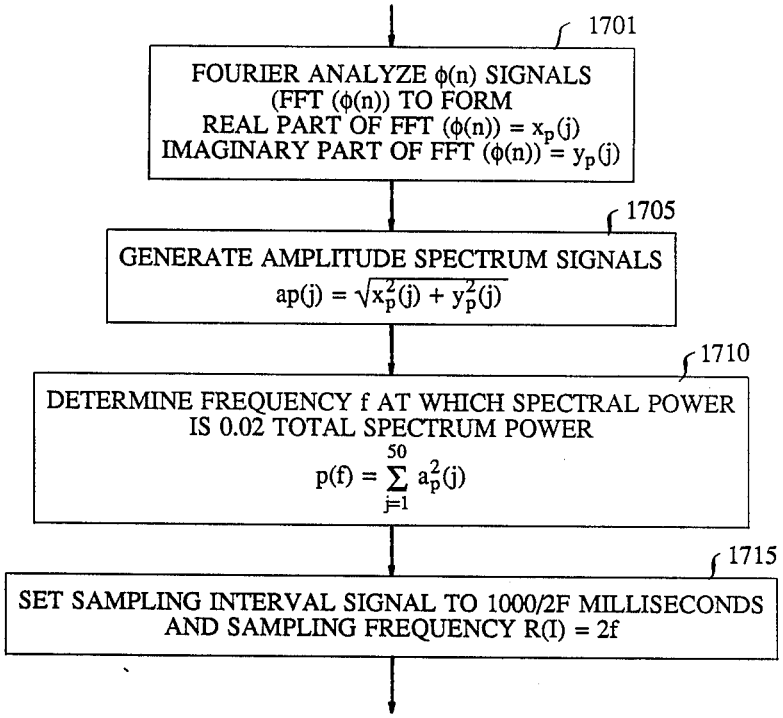
FIG. 17 shows the sampling rate signal formation operation of FIG. 7 in greater detail.

Referring to FIG. 7, the speech event index I is reset to one as per box 701 and the speech event feature signal $\phi_I(n)$ is read from store 255. The sampling rate $R_I$ for the current speech event feature signal is selected in box 710 by one of the many methods well known in the art. In Appendix D, the instruction codes perform a Fourier analysis and generate a signal corresponding to the upper band limit of the feature signal from which a sampling rate signal $R_I$ is determined. In this way, the sampling rate of each speech event feature signal is limited to the bandwidth of that speech event signal. FIG. 17 illustrates the arrangement for determining the sampling rate signal $R_I$ of Appendix D. In FIG. 17, each signal $\phi(n)$ is analyzed to form a signal $x_p(j)$ corresponding to the real part of the fast Fourier transform of $\phi(n)$ and a signal $y_p(j)$ corresponding to the imaginary part of the fast Fourier transform of $\phi(n)$ (box 1701). Amplitude spectrum signals $a_p(j)$ are then generated and the frequency f at which the spectral power is 0.02 of the total spectrum power is determined. The sampling interval is then set to 1000/2f milliseconds and the sampling rate $R_I$ is made equal to 2f (box 1715). As is well known in the art, the sampling rate need only be sufficient to adequately represent the feature signal. Thus, a slowly changing feature signal may utilize a lower sampling rate than a rapidly changing feature signal and the sampling rate for each feature signal may be different.

Once a sampling rate signal has been determined for speech event feature signal $\phi_I(n)$, it is encoded at rate $R_I$ as per box 715. Any of the well-known encoding schemes can be used. For example, each sample may be converted into a PCM, ADPCM or Δ modulated signal and concatenated with a signal indicative of the feature signal location in the speech pattern and a signal representative of the sampling rate $R_I$. The coded speech event feature signal is then transferred to utilization device 285 via input output interface 265. Speech event index I is then incremented (box 720) and decision box 725 is entered to determine if the last speech event signal has been coded. The loop including boxes 705 through 725 is iterated until the last speech event signal has been encoded ($I>I_F$) at which time the coding of the speech event feature signals is completed.

The speech event feature signals must be combined in accordance with equation 1 to form replicas of the log area feature signals therein. Accordingly, the combining coefficients for the speech pattern are generated and encoded as shown in the flow chart of FIG. 8. After the speech event feature signal encoding, central processor 275 is conditioned to read the contents of ROM 225. The instruction codes permanently stored in the ROM control the formation and encoding of the combining coefficients and are listed in Fortran language in Appendix E hereto.

Figure 8:
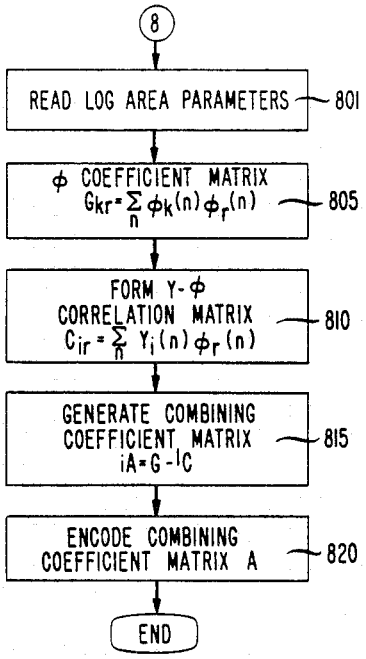

The combining coefficients are produced for the entire speech pattern by matrix processing in central processor 275 and arithmetic processor 280. Referring to FIG. 8, the log area parameters of the speech pattern are transferred to processor 275 as per box 801. A speech event feature signal coefficient matrix G is generated (box 805) in accordance with $$g_{kr} = \sum_n \phi_k(n)\phi_r(n) \tag{26}$$

and a Y-Φ correlation matrix C is formed (box 810) in accordance with $$c_{ir} = \sum_n y_i(n)\phi_r(n) \tag{27}$$

The combining coefficient matrix is then produced as per box 815 according to the relationship $$A=G^{-1}C \tag{28}$$

The elements of matrix A are the combining coefficients $a_{ik}$ of equation 1. These combining coefficients are encoded, as is well known in the art, in box 820 and the encoded coefficients are transferred to utilization device 285.

In accordance with the invention, the linear predictive parameters sampled at a rate corresponding to the most rapid change therein are converted into a sequence of speech event feature signals that are encoded at the much lower speech event occurrence rate and the speech pattern is further compressed to reduce transmission and storage requirements without adversely affecting intelligibility. Utilization device 285 may be a communication facility connected to one of the many speech synthesizer circuits using an LPC all pole filter known in the art.

The circuit of FIG. 2 is adapted to compress a spoken message into a sequence of coded speech event feature signals which are transmitted via utilization device 285 to a synthesizer. In the synthesizer, the speech event feature signals and the combining coefficients of the message are decoded and recombined to form the message log area parameter signals. These log area parameter signals are then utilized to produce a replica of the original message.

Figure 9:
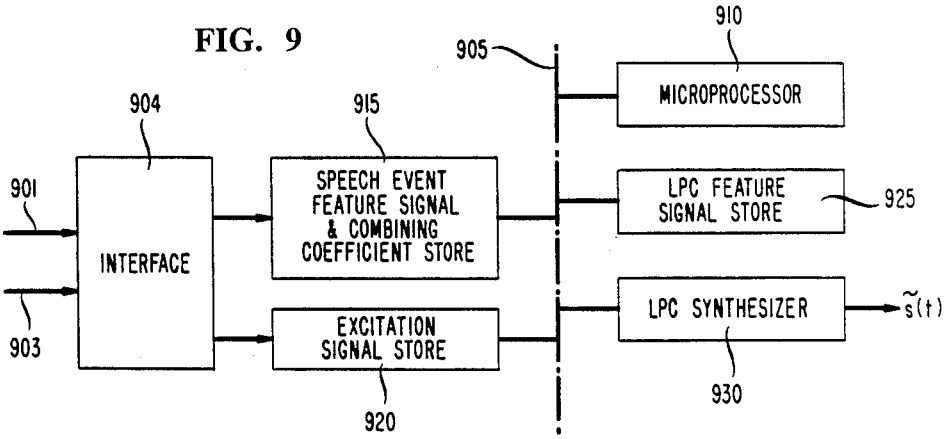
FIG. 9 depicts a speech synthesizer illustrative of the invention.
Figure 10:
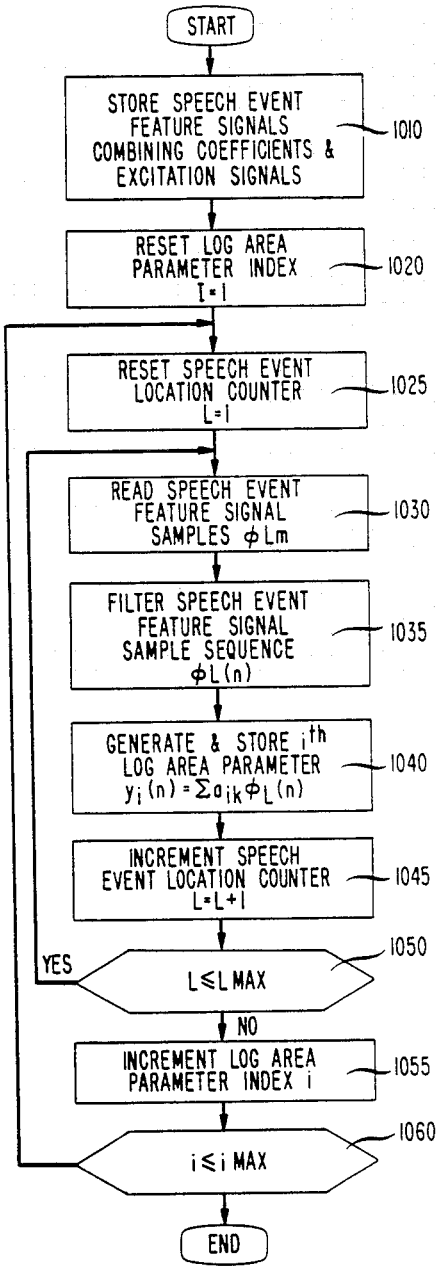
FIG. 10 depicts a flow chart illustrating the operation of the circuit of FIG. 9.

FIG. 9 depicts a block diagram of a speech synthesizer circuit illustrative of the invention and FIG. 10 shows a flow chart illustrating its operation. Store 915 of FIG. 9 is adapted to store the successive coded speech event feature signals and combining signals received from utilization device 285 of FIG. 2 via line 901 and interface circuit 904. Store 920 receives the sequence of excitation signals required for synthesis via line 903. The excitation signals may comprise a succession of pitch period and voiced/unvoiced signals generated responsive to the voice message by methods well known in the art or may comprise a sequence of multipulse excitation signals as described in U.S. patent application Ser. No. 326,371 filed Dec. 1, 1982. Microprocessor 910 is adapted to control the operation of the synthesizer and may be the aforementioned Motorola-type MC68000 integrated circuit. LPC feature signal store 925 is utilized to store the successive log area parameter signals of the spoken message which are formed from the speech event feature signals and combining signals of store 915. Formation of a replica of the spoken message is accomplished in LPC synthesizer 930 responsive to the LPC feature signals from store 925 and the excitation signals from store 920 under control of microprocessor 910.

The synthesizer operation is directed by microprocessor 910 under control of permanently stored instruction codes resident in a read only memory associated therewith. These instruction codes are listed in FORTRAN language form in Appendix F. The operation of the synthesizer is described in the flow chart of FIG. 10. Referring to FIG. 10, The coded speech event feature signals, the corresponding combining signals, and the excitation signals of the spoken message are received by interface 904 and are transferred to speech event feature signal and combining coefficient signals store 915 and to excitation signal store 920 as per box 1010. The log area parameter signal index I is then reset to one in processor 910 (box 1020) so that the reconstruction of the first log area feature signal $y_1(n)$ is initiated.

The formation of the log area signal requires combining the speech event feature signals with the combining coefficients of index I in accordance with equation 1. Speech event feature signal location counter L is reset to one by processor 910 as per box 1025 and the current speech event feature signal samples are read from store 915 (box 1030). The signal sample sequence is filtered to smooth the speech event feature signal as per (box 1035) and the current log area parameter signal is partially formed in box 1040. Speech event location counter L is incremented to address the next speech event feature signal in store 915 (box 1045) and the occurrence of the last feature signal is tested in decision box 1050. Until the last speech event feature signal has been processed, the loop including boxes 1030 through 1050 is iterated so that the current log area parameter signal is generated and stored in LPC feature signal store 925 under control of processor 910.

Upon storage of a log area feature signal in store 925, box 1055 is entered from box 1050 and the log area index signal I is incremented (box 1055) to initiate the formation of the next log area parameter signal. The loop from box 1030 through box 1050 is reentered via decision box 1060. After the last log area parameter signal is stored, processor 910 is conditioned as per the instruction codes described in Appendix F to cause a replica of the spoken message to be formed in LPC synthesizer 930.

The synthesizer circuit of FIG. 9 may be readily modified to store the speech event feature signal sequences corresponding to a plurality of spoken messages and to selectively generate replicas of these messages by techniques well known in the art. For such an arrangement, the speech event feature signal generating circuit of FIG. 2 may receive a sequence of predetermined spoken messages and utilization device 285 may comprise a arrangement to permanently store the speech event feature signals and corresponding combining coefficients for the messages and to generate a read only memory containing said spoken message speech event and combining signals. The read only memory containing the coded speech event and combining signals can be inserted as store 915 in the synthesizer circuit of FIG. 9.

The invention has been described with reference to a particular embodiment illustrative thereof. It is to be understood, however, that various modifications and changes may be made by one skilled in the art without departing from the spirit and scope of the invention.

APPENDIX A

```
c LPC ANALYSIS (FIG. 3)
      common /SPSTOR/ nsampl,s(8000)
      common /ARSTOR/ nframe,area(500,16),av(16)
      real rc(16),ar(17),avg(16)
      data (avg(i),i=1,16)/
     &-0.60,1.60,0.50,1.30,0.50,0.60,0.20,0.10,
     &+0.10,0.10,0.40,0.40,0.30,0.30,0.20,0.10/
      rewind 11
      read(11)nsampl,s
      call scopy(16,avg,av)
      x=0.0
      do5n=1,nsampl
      x=s(n)
    5 s(n)=s(n)-0.5*x
      nframe=1
      n=1
      nss=1
  100 continue
      if(nss+160.gt.nsampl)goto1
      if(nss.gt.16)call lpcanl(s(nss-16),176,rc)
      if(nss.le.16)call lpcanl(s(nss),160+(16-nss),rc)
      call rcnlar(rc,16,ar)
      do2i=1,16
    2 area(n,i)=ar(i)
      nss=nss+16
      n=n+1
      goto100
    1 continue
      N=n-1
      do4i=1,n
      do6k=1,16
    6 area(n,k)=area(n,k)-av(k)
    4 continue
      nframe=N
      rewind 40
      write(40)nframe,area,av
      endfile 40
```

-continued

APPENDIX A

```
      stop
      end
cCHLSKY Cholesky Decomposition
      Subroutine CHLSKY (a,n,t)
      dimension a(n,n),t(n)
      do100i=1,n
      do100j=1,i
      sm=a(j,i)
      if(j.eq.1)goto102
      do101k=1,j-1
  101 sm=sm-a(i,k)*a(j,k)
  102 if(j.ne.i)goto103
      t(j)=sqrt(sm)
      t(j)=1./t(j)
      goto100
  103 a(i,j)=sm*t(j)
  100 continue
  500 do400i=1,n
  400 a(i,i)=1./t(i)
      return
      end
cCOVLPC Covariance LPC Analysis
      Subroutine COVLPC (phi,shi,np,rc,ps)
      dimension phi(np,np),shi(np),rc(np),d(17)
      call chlsky(phi,np,rc)
      call lwrtrn(phi,np,rc,shi)
      ee=ps
      do3i=1,np
      ee=ee-rc(i)*rc(i)
      d(i)=sqrt(ee)
    3 continue
    4 continue
      rc(1)=-rc(1)/sqrt(ps)
      do5i=2,np
    5 rc(i)=-rc(i)/d(i-1)
      return
      end
cLPCANL LPC Analysis Program
      Subroutine LPCANL (s,ls,c)
      real s(1),c(1)
      real p(17)
      real phi(16,16),shi(16)
      real w(160)
      data init/0/
      if(init.gt.0)goto100
      do1i=1,160
    1 w(i)=0.5-0.5*cos(2.0*3.14159*(i-1)/160)
      init=1
  100 continue
      np=16
c+++  Compute Covariance Matrix and Correlation Vector
c+++  ps = speech energy c+++  shi = correlation
 vector c+++  phi = covariance matrix
      ps=tdot(s(np+1),s(np+1),w,ls-np)
      do2i=1,np
      shi(i)=tdot(s(np+1),s(np+1-i),w,ls-np)
      do2j=1,i
      sm=tdot(s(np+1-i),s(np+1-j),w,ls-np)
      phi(i,j)=sm
      phi(j,i)=sm
    2 continue
      do4i=1,np
    4 p(i)=phi(i,i)
      call chlsky(phi,np,c)
      call lwrtrn(phi,np,c,shi)
      ee=ps
      do5i=1,np
      ee=ee-c(i)*c(i)
    5 continue
      pre=ee*0.10
      do6i=1,np
      do6j=i,np
    6 phi(j,i)=phi(i,j)
      do7i=1,np
      phi(i,i)=p(i)+pre*0.375
      if(i.ge.2)phi(i,i-1)=phi(i,i-1)-0.25*pre
      if(i.ge.3)phi(i,i-2)=phi(i,i-2)+0.0625*pre
      if(i.lt.np)phi(i,i+1)=phi(i,i+1)-0.25*pre
      if(i.lt.np-1)phi(i,i+2)=phi(i,i+2)+0.0625*pre
    7 continue
      shi(1)=shi(1)-0.25*pre
```

-continued

APPENDIX A

```
      shi(2)=shi(2)+0.0625*pre
      ps=ps+pre*0.375
      call covlpc(phi,shi,np,c,ps)
      return
      end
cLWRTRN Solve Lower Triangular Equations
      Subroutine LWRTRN (a,n,x,y)
      dimension a(n,n),x(1),y(1)
      x(1)=y(1)/a(1,1)
      do1i=2,n
      sm=y(i)
      do2j=2,i
    2 sm=sm-a(i,j-1)*x(j-1)
    1 x(i)=sm/a(i,i)
      return
      end
cRCNLAR Convert Reflection Coefficients to Normalized Log
Areas
      Subroutine RCNLAR (rc,np,area)
      real rc(np),area(np)
      call reflar(rc,np,area)
      do1i=1,np
    1 area(i)=-alog(area(i)/area(np+1))
      return
      end
cREFLAR Convert Reflection Coefficients to Area
      Subroutine REFLAR (rc,nrc,ar)
      dimension rc(nrc),ar(nrc)
      ar(1)=1.0
      do32i=2,nrc+1
   32 ar(i)=ar(i-1)*(1+rc(i-1))/(1-rc(i-1))
      return
      end
cSCOPY Copy A to B
      Subroutine SCOPY (n,x,y)
      real x(n),y(n)
      do1i=1,n
    1 y(i)=x(i)
      return
      end
cTDOT Tripple Dot Product Function
      Function tdot(x,y,z,n)
      real x(n),y(n),z(n)
      tdot=0
      do1i=1,n
    1 tdot=tdot+x(i)*y(i)*z(i)
      return
      end
```

APPENDIX B

```
c  Timing Analysis (FIG. 4)
      common /ARSTOR/ nframe,area(500,16),av(16)
      common /TIMING/ lval,nu(160)
      common /LSSTOR/lmax,loc(20)
      real ax(16,16),bx(10,10)
      real v(16,16),ev(125,16),dev(16)
      real u(125,4),wu(125,4)
      real z(125,16),phi(125)
      data np/16/,inctim/5/,ltsegm/125/,dtpar/0.002/
      rewind 40
      read(40)nframe,area,av
      L=1
      n=1
  100 continue
c+++  Set Window for Timing Analysis
      n1=n-(ltsegm-1)/2
      n2=n+(ltsegm-1)/2
      n1=max0(n1,1)
      n2=min0(n2,nframe)
      ltseq=n2-n1+1
      if(ltseg.lt.np+10)ltseg=np+10
      n1=min0(n1,nframe-ltseg+1)
c+++  Read New Frames of Area Data
      do101k=1,np
  101 call scopy(ltseg,area(n1,k),z(1,k))
c+++  Compute Principal Components of z
      ncomp=4
```

-continued

APPENDIX B

```
      do1i=1,np
      do1j=1,i
      ax(i,j)=sdot(ltseg,z(1,i),z(1,j))
    1 ax(j,i)=ax(i,j)
      call svd(ax,np,16,np,ev,np,dev,v,np,16)
      do2j=1,ltseg
      do2i=1,ncomp
      sm=0
      do4k=1,np
    4 sm=sm+z(j,k)*v(k,i)
    2 u(j,i)=sm/dev(i)
c+++    Select Nearest Most Compact Component phi
      do12j=1,ncomp
      do11i=1,ltseg
      wtf=(i-n+n1-1)
   11 wu(i,j)=u(i,j)*wtf
   12 continue
      do13i=1,ncomp
      do13j=1,i
      bx(i,j)=sdot(ltseg,wu(1,i),wu(1,j))
   13 bx(j,i)=bx(i,j)
      call svd(bx,ncomp,10,ncomp,ev,ncomp,dev,v,ncomp,16)
      phimax=0
      imax=1
      do42i=1,ltseg
      sm=0
      do41k=1,ncomp
   41 sm=sm+u(i,k)*v(k,ncomp)
      if(abs(sm).gt.phimax)imax=i
      phimax=amax1(phimax,abs(sm))
   42 phi(i)=sm
      if(phi(imax).lt.0.0)call chgsgn(phi,ltseg)
      nu(L)=n1+imax-n
      L=L+1
      n=n+5
      if(n.lt.nframe)goto100
      lmax=L-1
      call zercrs
      do201=1,1max
   20 loc(1)=(loc(1)-1)*inctim+1
      rewind 45
      write(45)lval,nu
      endfile 45
      rewind 50
      write(50)lmax,loc
      endfile 50
      stop
      end
cCHGSGN change sign of an array
      Subroutine CHGSGN (x,1x)
      dimension x(1x)
      do1i=1,1x
    1 x(i)=-x(i)
      return
      end
cSCOPY Copy A to B
      Subroutine SCOPY (n,x,y)
      real x(n),y(n)
      do1i=1,n
    1 y(i)=x(i)
      return
      end
cSD0T   Inner Product of Two Vectors
      Function SDOT (n,x,y)
      real x(n),y(n)
      sdot=0
      do1i=1,n
    1 sdot=sdot+x(i)*y(i)
      return
      end
c SVD Singular-Value Decomposition of a Rectangular Matrix
      Subroutine SVD(a,m,mmax,n,u,nu,s,v,nv,nmax)
      dimension a(mmax,n),u(mmax,n),v(nmax,n)
      integer m,n,p,nu,nv
      dimension s(n)
      dimension b(100),c(100),t(100)
      data eta,tol/1.5e-8,1.e-31/
      p=0
    1 np=n+p
      n1=n+1
c householder reduction
```

-continued

APPENDIX B

```
      c(1)=0.e0
      k=1
   10 k1=k+1
c elimination of a(i,k), i=k+1,...,m
      z=0.e0
      do 20 i=k,m
   20 z=z+a(i,k)**2
      b(k)=0.e0
      if(z.le.tol) goto 70
      z=sqrt(z)
      b(k)=z
      w=abs(a(k,k))
      q=1.e0
      if(w.ne.0.e0) q=a(k,k)/w
      a(k,k)=q*(z+w)
      if(k.eq.np) goto 70
      do 50 j=k1,np
      q=0.e0
      do 30 i=k,m
   30 q=q+a(i,k)*a(i,j)
      q=q/(z*(z+w))
      do 40 i=k,m
   40 a(i,j)=a(i,j)-q*a(i,k)
   50 continue
c phase transformation
      q=-a(k,k)/abs(a(k,k))
      do 60 j=k1,np
   60 a(k,j)=q*a(k,j)
c elimination of a(k,j), j=k+2,...,n
   70 if(k.eq.n) goto 140
      z=0.e0
      do 80 j=k1,n
   80 z=z+a(k,j)**2
      c(k1)=0.e0
      if(z.le.tol) goto 130
      Z=sqrt(z)
      c(k1)=z
      w=abs(a(k,k1))
      q=1.e0
      if(w.ne.0.e0) q=a(k,k1)/w
      a(k,k1)=q*(z+w)
      do 110 i=k1,m
      q=0.e0
      do 90 j=k1,n
   90 q=q+a(k,j)*a(i,j)
      q=q/(z*(z+w))
      do 100 j=k1,n
  100 a(i,j)=a(i,j)-q*a(k,j)
  110 continue
c phase transformation
      q=-a(k,k1)/abs(a(k,k1))
      do 120 i=k1,m
  120 a(i,k1)=a(i,k1)*q
  130 k=k1
      goto 10
c tolerance for negligible elements
  140 eps=0.e0
      do 150 k=1,n
      s(k)=b(k)
      t(k)=c(k)
  150 eps=amax1(eps,s(k)+t(k))
      eps=eps*eta
c initialization of u and v
      if(nu.eq.0) qoto 180
      do 170 j=1,nu
      do 160 i=1,m
  160 u(i,j)=0.e0
  170 u(j,j)=1.e0
  180 if(nv.eq.0) goto 210
      do 200 j=1,nv
      do 190 i=1,n
  190 v(i,j)=0.e0
  200 v(j,j)=1.e0
c qr diagonalization
  210 do 380 kk=1,n
      k=n1-kk
c test for split
  220 do 230 11=1,k
      l=k+1-11
      if(abs(t(l)).le.eps) goto 290
      if(abs(s(l-1)).le.eps) goto 240
```

-continued

APPENDIX B

```
  230 continue
c  cancellation
  240 cs=0.e0
      sn=1.e0
      l1=l-1
      do 280 i=l,k
      f=sn*t(i)
      t(i)=cs*t(i)
      if(abs(f).le.eps) goto 290
      h=s(i)
      w=sqrt(f*f+h*h)
      s(i)=w
      cs=h/w
      sn=-f/w
      if(nu.eq.0) goto 260
      do 250 j=1,n
      x=u(j,l1)
      y=u(j,i)
      u(j,l1)=x*cs+y*sn
  250 u(j,i)=y*cs-x*sn
  260 if(np.eq.n) goto 280
      do 270 j=n1,np
      q=a(l1,j)
      r=a(i,j)
      a(l1,j)=q*cs+r*sn
  270 a(i,j)=r*cs-q*sn
  280 continue
c  test for convergence
  290 w=s(k)
      if(l.eq.k) goto 360
c  origin shift
      x=s(l)
      y=s(k-1)
      g=t(k-1)
      h=t(k)
      f=((y-w)*(Y+w)+(g-h)*(g+h))/(2.e0*h*y)
      g=sqrt(f*f+1.e0)
      if(f.lt.0.e0) g=-g
      f=((x-w)*(x+w)+(y/(f+g)-h)*h)/x
c  qr step
      cs=1.e0
      sn=1.e0
      l1=l+1
      do 350 i=l1,k
      g=t(i)
      y=s(i)
      h=sn*g
      g=cs*g
      w=sqrt(h*h+f*f)
      t(i-1)=w
      cs=f/w
      sn=h/w
      f=x*cs+g*sn
      g=g*cs-x*sn
      h=y*sn
      y=y*cs
      if(nv.eq.0) goto 310
      do 300 j=1,n
      x=v(j,i-1)
      w=v(j,i)
      v(j,i-1)=x*cs+w*sn
  300 v(j,i)=w*cs-x*sn
  310 v=sqrt(h*h+f*f)
      s(i-1)=w
      cs=f/w
      sn=h/w
      f=cs*g+sn*y
      x=cs*y-sn*g
      if(nu.eq.0) goto 330
      do 320 j=1,n
      y=u(j,i-1)
      w=u(j,i)
      u(j,i-1)=y*cs+w*sn
  320 u(j,i)=w*cs-y*sn
  330 if(n.eq.np) goto 350
      do 340 j=n1,np
      q=a(i-1,j)
      r=a(i,j)
      a(i-1,j)=q*cs+r*sn
  340 a(i,j)=r*cs-q*sn
  350 continue
```

-continued

APPENDIX B

```
      t(l)=0.e0
      t(k)=f
      s(k)=x
      goto 220
c  convergence
  360 if(w.ge.0.e0) goto 380
      s(k)=-w
      if(nv.eq.0) goto 380
      do 370 j=1,n
  370 v(j,k)=-v(j,k)
  380 continue
c sort singular values
      do 450 k=1,n
      g=-1.e0
      j=k
      do 390 i=k,n
      if(s(i).le.g) goto 390
      g=s(i)
      j=i
  390 continue
      if(j.eq.k) goto 450
      s(j)=s(k)
      s(k)=g
      if(nv.eg.0) goto 410
      do 400 i=1,n
      q=v(i,j)
      v(i,j)=v(i,k)
  400 v(i,k)=q
  410 if(nu.eq.0) goto 430
      do 420 i=1,n
      q=u(i,j)
      u(i,j)=u(i,k)
  420 u(i,k)=q
  430 if(n.eq.np) goto 450
      do 440 i=n1,np
      q=a(j,i)
      a(j,i)=a(k,i)
  440 a(k,i)=q
  450 continue
c back transformation
      if(nu.eq.0) goto 510
      do 500 kk=1,n
      k=n1-kk
      if(b(k).eq.0.e0) goto 500
      q=-a(k,k)/abs(a(k,k))
      do 460 j=1,nu
  460 u(k,j)=q*u(k,j)
      do 490 j=1,nu
      q=0.e0
      do 470 i=k,m
  470 q=q+a(i,k)*u(i,j)
      q=q/(abs(a(k,k))*b(k))
      do 480 i=k,m
  480 u(i,j)=u(i,j)-q*a(i,k)
  490 continue
  500 continue
  510 if(nv.eq.0) goto 570
      if(n.lt.2) goto 570
      do 560 kk=2,n
      k=n1-kk
      k1=k+1
      if(c(k1).eq.0.e0) goto 560
      q=-a(k,k1)/abs(a(k,k1))
      do 520 j=1,nv
  520 v(k1,j)=q*v(k1,j)
      do 550 j=1,nv
      q=0.e0
      do 530 i=k1,n
  530 q=q+a(k,i)*v(i,j)
      q=q/(abs(a(k,k1))*c(k1))
      do 540 i=k1,n
  540 v(i,j)=v(i,j)-q*a(k,i)
  550 continue
  560 continue
  570 return
      end
cZERCRS Zero Crossings of Timing Signal
      Subroutine ZERCRS
      common /TIMING/ lval,nu(160)
      common /LSSTOR/lmax,loc(20)
      im=1
```

-continued

APPENDIX B

```
      lmax=1
      loc(lmax)=1
  100 continue
      i1=im
      iz=0 c+++      Determine the Next Peak
      do1i=im+1,lval-1
      ip=i
      if(nu(i).le.nu(i+1))goto1
      if(nu(i).lt.nu(i-1))goto1
      if(nu(i).gt.nu(i-1))goto61
      if(i-2.gt.0.and.nu(i).gt.nu(i-2))goto61
      if(i-3.gt.0.and.nu(i).gt.nu(i-3))goto61
      goto1
   61 continue
      goto11
    1 continue
      goto50
c+++      Determine the Next Minimum
   11 do2i=ip,lval-1
      im=i
      if(nu(i).gt.nu(i+1))goto2
      if(nu(i).ge.nu(i-1))goto2
      goto12
    2 continue
      goto50
   12 continue
      if(im-ip.lt.2)goto100
c+++      Find the Nearest Zero Crossing
      do3i=ip,im
      iz=i
      if(nu(i).gt.0.0.and.nu(i+1).le.0.0)goto13
    3 continue
      if(nu(im).gt.0.0)iz=im
      if(nu(ip).lt.0.0)iz=im
      goto30
   13 continue
   30 continue
      lmax=lmax+1
      loc(lmax)=(iz)
      goto100
   50 continue
      lmax=lmax+1
      loc(lmax)=lval
      return
      end
```

APPENDIX C

```
c          Generate Speech Event Feature Signals (FIG. 6)
           common /ARSTOR/ nframe,area(500,16),av(16)
           common /TIMING/ lval,nu(160)
           common /LSSTOR/ lmax,loc(20)
           common /PHISTO/ lbeg(20),lend(20),phi(125,20)
           real ax(16,16),bx(10,10)
           real v(16,16),ev(125,16),dev(16)
           real u(125,4),wu(125,4)
           real z(125,16)
           data np/16/,inctim/5/,ltsegm/125/,dtpar/0.002/
           I=1
           rewind 40
           read(40)nframe,area,av
           rewind 45
           read(45)lval,nu
           rewind 50
           read(50)lmax,loc
       100 continue
           l=I c+++   Set Window for Timing Analysis
           n1=max0(1,loc(1))
           n2=min0(loc(lmax),lval)
           if(l.gt.2)n1=loc(1-2)
           if(l.le.lmax-2)n2=loc(l+2)
           ltseg=n2-n1+1
           if(ltseg.lt.np+10)ltseg=np+10
           n1=min0(n1,nframe-ltseg+1)
           lbeg(l)=n1
           lend(l)=n2
c+++       Determine Number of Speech Events in the Window
           m=0
           do32j=1,lmax
           if(loc(l).lt.lbeg(l))goto32
```

APPENDIX C-continued

```
           if(loc(l).gt.lend(l))goto32
           m=m+1
        32 continue
           m=min0(6,m)
           m=max0(4,m)
c+++       Read New Frames of Area Data
           do101k=1,np
       101 call scopy(ltseg,area(n1,k),z(1,k))
c+++       Compute Principal Components of z
           ncomp=m
           do1k=1,np
           do1j=1,k
           ax(k,j)=sdot(ltseg,z(1,k),z(1,j))
         1 ax(j,k)=ax(k,j)
           call svd(ax,np,16,np,ev,np,dev,v,np,16)
           do2n=1,ltseg
           do2j=1,m
           sm=0
           do4k=1,np
         4 sm=sm+z(n,k)*v(k,j)
         2 u(n,k)=sm/dev(k)
c+++       Select Nearest Most Compact Component phi
           do12j=1,m
           do11n=1,ltseg
           wtf=(n-loc(l)+n1-1)
        11 wu(n,j)=u(n,j)*wtf
        12 continue
           do13j=1,m
           do13k=1,j
           bx(j,k)=sdot(ltseg,wu(1,j),wu(1,k))
        13 bx(k,j)=bx(j,k)
           call svd(bx,m,10,m,ev,m,dev,v,m,16)
           phimax=0
           nmax=1
           do42n=1,ltseg
           sm=0
           do41j=1,m
        41 sm=sm+u(n,j)*v(j,m)
           if(abs(sm).gt.phimax)nmax=n
           phi(nmax)=amax1(phimax,abs(sm))
        42 phi(n,I)=sm
           if(phimax.lt.0.0)call chgsgn(phi(1,I),ltseg)
           I=I+1
           if(I.lt.lmax)goto100
           rewind 55
           write(55)lbeg,lend,phi
           endfile 55
           stop
           end
cCHGSGN    change sign of an array
           Subroutine CHGSGN (x,lx)
           dimension x(lx)
           do1i=1,lx
         1 x(i)=-x(i)
           return
           end
cSCOPY     Copy A to B
           Subroutine SCOPY (n,x,y)
           real x(n),y(n)
           do1i=1,n
         1 y(i)=x(i)
           return
           end
cSDOT      Inner Product of Two Vectors
           Function SDOT (n,x,y)
           real x(n),y(n)
           sdot=0
           do1i=1,n
         1 sdot=sdot+x(i)*y(i)
           return
           end
c SVD      Singular-Value Decomposition of a
           Rectangular Matrix
           Subroutine SVD(a,m,mmax,n,u,nu,s,v,nv,nmax)
           dimension a(mmax,n),u(mmax,n),v(nmax,n)
           integer m,n,p,nu,nv
           dimension s(n)
           dimension b(100),c(100),t(100)
           data eta,tol/1.5e-8,1.e-31/
           p=0
         1 np=n+p
           n1=n+1
```

APPENDIX C-continued

```
c       householder reduction
        c(1)=0.e0
        k=1
     10 k1=k+1
c       elimination of a(i,k), i=k+1, . . . ,m
        z=0.e0
        do 20 i=k,m
     20 z=z+a(i,k)**2
        b(k)=0.e0
        if(z.le.tol) goto 70
        z=sqrt(z)
        b(k)=z
        w=abs(a(k,k))
        q=1.e0
        if(w.ne.0.e0) q=a(k,k)/w
        a(k,k)=q*(z+w)
        if(k.eq.np) goto 70
        do 50 j=k1,np
        q=0.e0
        do 30 i=k,m
     30 q=q+a(i,k)*a(i,j)
        q=q/(z*(z+w))
        do 40 i=k,m
     40 a(i,j)=a(i,j)-q*a(i,k)
     50 continue
c       phase transformation
        q=-a(k,k)/abs(a(k,k))
        do 60 j=k1,np
     60 a(k,j)=q*a(k,j)
c       elimination of a(k,j), j=k+2, . . . ,n
     70 if(k.eq.n) goto 140
        z=0.e0
        do 80 j=k1,n
     80 z=z+a(k,j)**2
        c(k1)=0.e0
        if(z.le.tol) goto 130
        z=sqrt(z)
        c(k1)=z
        w=abs(a(k,k1))
        q=1.e0
        if(w.ne.0.e0) q=a(k,k1)/w
        a(k,k1)=q*(z+w)
        do 110 i=k1,m
        q=0.e0
        do 90 j=k1,n
     90 q=q+a(k,j)*a(i,j)
        q=q/(z*(z+w))
        do 100 j=k1,n
    100 a(i,j)=a(i,j)-q*a(k,j)
    110 continue
c       phase transformation
        q=-a(k,k1)/abs(a(k,k1))
        do 120 i=k1,m
    120 a(i,k1)=a(i,k1)*q
    130 k=k1
        goto 10
c       tolerance for negligible elements
    140 eps=0.e0
        do 150 k=1,n
        s(k)=b(k)
        t(k)=c(k)
    150 eps=amax1(eps,s(k)+t(k))
        eps=eps*eta
c       initialization of u and v
        if(nu.eq.0) goto 180
        do 170 j=1,nu
        do 160 i=1,m
    160 u(i,j)=0.e0
    170 u(j,j)=1.e0
    180 if(nv.eq.0) goto 210
        do 200 j=1,nv
        do 190 i=1,n
    190 v(i,j)=0.e0
    200 v(j,j)=1.e0
c gr    diagonalization
    210 do 380 kk=1,n
        k=n1-kk
c       test for split
    220 do 230 ll=1,k
        l=k+1-ll
        if(abs(t(l)).le.eps) goto 290
        if(abs(s(l-1)).le.eps) goto 240
```

APPENDIX C-continued

```
    230 continue
c       cancellation
    240 cs=0.e0
        sn=1.e0
        l1=l-1
        do 280 i=l,k
        f=sn*t(i)
        t(i)=cs*t(i)
        if(abs(f).le.eps) goto 290
        h=s(i)
        w=sqrt(f*f+h*h)
        s(i)=w
        cs=h/w
        sn=-f/w
        if(nu.eq.0) goto 260
        do 250 j=1,n
        x=u(j,l1)
        y=u(j,i)
        u(j,l1)=x*cs+y*sn
    250 u(j,i)=y*cs-x*sn
    260 if(np.eq.n) goto 280
        do 270 j=n1,np
        q=a(l1,j)
        r=a(i,j)
        a(l1,j)=q*cs+r*sn
    270 a(i,j)=r*cs-q*sn
    280 continue
c       test for convergence
    290 w=s(k)
        if(l.eq.k) goto 360
c       origin shift
        x=s(l)
        y=s(k-1)
        g=t(k-1)
        h=t(k)
        f=((y-w)*(y+w)+(g-h)*(g+h))/(2.e0*h*y)
        g=sqrt(f*f+1.e0)
        if(f.lt.0.e0) g=-g
        f=((x-w)*(x+w)+(y/(f+g)-h)*h)/x
c       qr step
        cs=1.e0
        sn=1.e0
        l1=l+1
        do 350 i=l1,k
        g=t(i)
        y=s(i)
        h=sn*g
        g=cs*g
        w=sqrt(h*h+f*f)
        t(i-1)=w
        cs=f/w
        sn=h/w
        f=x*cs+g*sn
        g=g*cs-x*sn
        h=y*sn
        y=y*cs
        if(nv.eq.0) goto 310
        do 300 j=1,n
        x=v(j,i-1)
        w=v(j,i)
        v(j,i-1)=x*cs+w*sn
    300 v(j,i)=w*cs-x*sn
    310 w=sqrt(h*h+f*f)
        s(i-1)=w
        cs=f/w
        sn=h/w
        f=cs*g+sn*y
        x=cs*y-sn*g
        if(nu.eq.0) goto 330
        do 320 j=1,n
        y=u(j,i-1)
        w=u(j,i)
        u(j,i-1)=y*cs+w*sn
    320 u(j,i)=w*cs-y*sn
    330 if(n.eq.np) goto 350
        do 340 j=n1,np
        q=a(i-1,j)
        r=a(i,j)
        a(i-1,j)=q*cs+r*sn
    340 a(i,j)=r*cs-q*sn
    350 continue
        t(l)=0.e0
```

APPENDIX C-continued

```
      t(k)=f
      s(k)=x
      goto 220
c     convergence
  360 if(w.ge.0.e0) goto 380
      s(k)=-w
      if(nv.eq.0) goto 380
      do 370 j=1,n
  370 v(j,k)=-v(j,k)
  380 continue
c     sort singular values
      do 450 k=1,n
      g=-1.e0
      j=k
      do 390 i=k,n
      if(s(i).le.g) goto 390
      g=s(i)
      j=i
  390 continue
      if(j.eq.k) goto 450
      s(j)=s(k)
      s(k)=g
      if(nv.eq.0) goto 410
      do 400 i=1,n
      q=v(i,j)
      v(i,j)=v(i,k)
  400 v(i,k)=q
  410 if(nu.eq.0) goto 430
      do 420 i=1,n
      q=u(i,j)
      u(i,j)=u(i,k)
  420 u(i,k)=q
  430 if(n.eq.np) goto 450
      do 440 i=n1,np
      q=a(j,i)
      a(j,i)=a(k,i)
  440 a(k,i)=q
  450 continue
c     back transformation
      if(nu.eq.0) goto 510
      do 500 kk=1,n
      k=n1-kk
      if(b(k).eq.0.e0) goto 500
      q=-a(k,k)/abs(a(k,k))
      do 460 j=1,nu
  460 u(k,j)=q*u(k,j)
      do 490 j=1,nu
      q=0.e0
      do 470 i=k,m
  470 q=q+a(i,k)*u(i,j)
      q=q/(abs(a(k,k))*b(k))
      do 480 i=k,m
  480 u(i,j)=u(i,j)-q*a(i,k)
  490 continue
  500 continue
  510 if(nv.eq.0) goto 570
      if(n.lt.2) goto 570
      do 560 kk=2,n
      k=n1-kk
      k1=k+1
      if(c(k1).eq.0.e0) goto 560
      q=-a(k,k1)/abs(a(k,k1))
      do 520 j=1,nv
  520 v(k1,j)=q*v(k1,j)
      do 550 j=1,nv
      q=0.e0
      do 530 i=k1,n
  530 q=q+a(k,i)*v(i,j)
      q=q/(abs(a(k,k1))*c(k1))
      do 540 i=k1,n
  540 v(i,j)=v(i,j)-q*a(k,i)
  550 continue
  560 continue
  570 return
      end
```

APPENDIX D

```
      common /PHISTO/ lbeg(20),lend(20),phi(125,20)
      common /LSSTOR/ lmax,loc(20)
      real temp(25),xp(50),yp(50),ap(25)
```

APPENDIX D-continued

```
      real R(20)
      integer dtmsec
      rewind 55
      read(55)lbeg,lend,phi
      rewind 15
      I=1
  100 continue
      loczl=loczer(lend(I)-lbeg(I)+1,1,phi(1,I),1,0.10)
      loczr=loczer(lend(I)-lbeg(I)+1,2,phi(1,I),1.0.10)
      loczl=max0(1,loczl)
      if(loczr.eq.0)loczr=lend(I)-lbeg(I)
      k=0
      do101=loczl,loczr,5
      k=k+1
   10 temp(k)=phi(l,I)
      call rftpol(temp,k,xp,yp,50)
      do12j=1,5
   12 ap(j)=sqrt(xp(j)*kp(j)+yp(j)*yp(j))
      pwr=sdot(50,ap,ap)
      pp=pwr
      kl=0
      do5k=2,25
      pp=pp-ap(k-1)*ap(k-1)
      if(pp/pwr.gt.0.02)kl=k
    5 continue
      kl=max0(kl,4)
      dtmsec=max0((125/(kl-1))*2,12)
      R(I)=1000.0/dtmsec
      k=0
      do8l=loczl,loczr,dtmsec/2
      k=k+1
    8 temp(k)=phi(l,I)
      l1=loczl+lbeg(I)-1
      write(15)l1,k,kl,(temp(l),l=1,k)
      I=I+1
      if(I.lt.lmax)goto100
      endfile 15
      stop
      end
cFTRANS Fourier Transform Routine
      Subroutine FTRANS (x,nx,freq,smpint,rp,xp)
      dimension x(nx)
      dd=2.0*3.141592653*freq*smpint
      cosr1=cos(dd)
      cosr2=cos(2.0*dd)
      sinr1=-sin(dd)
      sinr2=-sin(2.0*dd)
      b1=-2*cosr1
      rp=0.0
      xp=0.0
      do1n=1,nx
      cosr=-b1*cosr1-cosr2
      sinr=-b1*sinr1-sinr2
      cosr2=cosr1
      cosr1=cosr
      sinr2=sinr1
      sinr1=sinr
      rp=rp+x(n)*cosr
      xp=xp+x(n)*sinr
    1 continue
      return
      end
cLOCZER Locate Left or Right Zero Crossing of a Function
      Function LOCZER (lx,iop,x,inc,frc)
      real x(lx)
      xmax=x(1)
      maxl=1
      do7i=2,lx
      if(x(i).le.xmax)goto7
      maxl=i
      xmax=x(i)
    7 continue
      thr=frc*x(maxl)
      goto(1,2),iop
    1 do10i=1,maxl-1,inc
      j=maxl+1-i
      if(x(j).gt.thr.and.x(j-1).le.thr)goto15
   10 continue
      loczer=0
      return
   15 loczer=j-1
      return
```

APPENDIX D-continued

```
      2 do20i=maxl,lx-1,inc
        if(x(i).gt.thr.and.x(i+1).le.thr)goto25
     20 continue
        loczer=0
        return
     25 loczer=i+1
        return
        end
cRFTPOL Regular Fourier Transform Routine
        Subroutine RFTP0L (x,lx,rp,xp,nftv)
        dimension x(lx),rp(nftv),xp(nftv)
        df=1.0/nftv
        mftv=nftv/2
        do1i=2,mftv
        call ftrans(x,(lx),(i-1)*df,1.0,xp(i),xp(nftv+2-i))
      1 xp(nftv+1-i)=-xp(nftv+1-i)
        call ftrans(x,(lx),mftv*df,1.0,rp1,xp1)
        call ftrans(x,(lx),0.0,1.0,rp0,xp0)
        xp1=-xp1
        xp0=-xp0
        do2i=2,mftv
        rp(nftv+2-i)=xp(i)
        rp(i)=xp(i)
      2 xp(i)=-xp(nftv+2-i)
        rp(1)=rp0
        rp(mftv+1)=rp1
        xp(1)=xp0
        xp(mftv+1)=xp1
        return
        end
cSDOT   Inner Product of Two Vectors
        Function SDOT (n,x,y)
        real x(n),y(n)
        sdot=0
        do1i=1,n
      1 sdot=sdot+x(i)*y(i)
        return
        end
```

APPENDIX E

```
        common /ARSTOR/ nframe,area(500,16),av(16)
        common /PHISTC/ lbeg(20),lend(20),phi(125,20)
        common /LSSTOR/lmax,loc(20)
        real G(20,20),C(20,16),GINV(20,20),a(16,20)
        data np/16/,inctim/5/,ltsegm/125/,dtpar/0.002/
        rewind 40
        read(40)inframe,area,av
        rewind 55
        read(55)lbeg,lend,phi
        rewind 50
        read(50)lmax,loc
c+++    Compute Speech Event Feature Signal Correlation
Matrix
        call zero(G,400)
        do15i=1,lmax
        do15j=i,lmax
        if(lbeg(j).gt.lend(i))goto15
        if(lbeg(i).gt.lend(j))goto15
        if(lend(i).ge.lbeg(j))ltseg=lend(i)-lbeg(j)+1
        if(lend(j).ge.lbeg(i))ltseg=lend(j)-lbeg(i)+1
        i1=max0(lbeg(j)-lbeg(i)+1,1)
        j1=max0(lbeg(i)-lbeg(j)+1,1)
        G(i,j)=sdot(ltseg,phi(i1,i),phi(j1,j))
     15 G(j,i)=G(i,j)
c++++   Compute Y-PHI Correlation Matrix
        do20i=1,np
        do11m=1,lmax
     11 C(i,m)=sdot(lend(m)-
lbeg(m)+1,area(lbeg(m),i),phi(1,m))
     20 continue
c++++   Generate Combining Coefficients
        call matinv(G,GINV,lmax)
        do35i=1,np
        do35k=1,lmax
        sm=0
        do30m=1,lmax
     30 sm=sm+GINV(k,m)*C(i,m)
     35 a(i,k)=sm
        rewind 60
        write(60)a
```

APPENDIX E-continued

```
        endfile 60
        stop
        end
cMATINV Inverse of a Positive-Definite Matrix
        Subroutine MATINV (a.b.n)
        real a(n,n),b(n,n)
        m=n
        mp1=m+1
        do100j=1,m
        sm=a(j,j)
        if(j.eq.1)goto102
        do101k=1,j-1
    101 sm=sm-b(j,k)*b(j,k)
    102 continue
        b(j,j)=sqrt(sm)
        xl=1./b(j,j)
        if(j.eq.m)goto110
        do100i=j+1,m
        sm=a(i,j)
        if(j.eq.1)goto104
        do103k=1,j-1
    103 sm=sm-b(i,k)*b(j,k)
    104 continue
    100 b(i,j)=sm*xl
    110 continue
        do350j=1,m
    350 b(j,j)=1./b(j,j)
        do200j=1,m-1
        do200i=j+1,m
        sm=0.
        do202k=j,i-1
    202 sm=sm+b(i,k)*b(k,j)
    200 b(i,j)=-sm*b(i,i)
        do300j=1,m
        jm=mp1-jm
        do300i=1,jm
        sm=0.
        do302k=jm,m
    302 sm=sm+b(k,i)*b(k,jm)
        b(i,jm)=sm
    300 continue
        do400i=1,m
        do400j=1,i
    400 b(i,j)=b(j,i)
        return
        end
cSDOT   Inner Product of Two Vectors
        Function SDOT (n,x,y)
        real x(n),y(n)
        sdot=0
        do1i=1,n
      1 sdot=sdot+x(i) y(i)
        return
        end
cZERO   Zero An Array
        Subroutine ZERO (x,n)
        real x(n)
        do1i=1,n
      1 x(i)=0.0
        return
        end
```

APPENDIX F

```
        common /PHIST0/ lbeg(20),lend(20),phi(125)
        common /ARSTOR/ nframe,area(500,16),av(16)
        common /RCSTOR/ rcstor(16,100)
        real avg(16),amp(16,20),philm(25)
        real temp(500)
        real h(250),b(250)
        real exc(80),fmem(16),sp(80)
        integer dtmsec
        data (avg(i),i=1,16)/
        &-0.60,1.60,0.50,1.30,0.50,0.60,0.20,0.10,
        &+0.10,0.10,0.40,0.40,0.30,0.30,0.20,0.10/
        data
np/16/,inctim/5/,ltsegm/125/,dtpar/0.002/,gamma/0.5/
c+++    915
        call scopy(np,avg,av)
        rewind 60
```

-continued

APPENDIX F

```
      read(60)amp
      i=1
  200 continue
      do1n=1,500
    1 area(n,i)=av(i)
      rewind 15
      L=1
  100 continue
      call zero(philm,25)
      read(15,end=250)l1,k,kl,(philm(j),j=1,k)
      lbeg(L)=l1
      lend(L)=l1+124
      nframe=lend(L)
      dtmsec=(125/(kl-1))*2
      lh=4*(dtmsec/2)
      ld=dtmsec/2
      call haming(h,lh)
      call zero(b,lh)
      call intrpl(philm,k,temp,lh/2+125,h,lh,ld,b)
      call scopy(125,temp(lh/2+1),phi)
      do33j=lbeg(L),lend(L)
   33 area(j,i)=area(j,i)+amp(i,L)*phi(j-lbeg(L)+1)
      L=L+1
      goto100
  250 continue
      i=i+1
      if(i.le.np)goto200
      do5i=1,np
      do5n=1,nframe
    5 area(n,i)=exp(area(n,1)-area(n,i))
      m=0
      do10n=1,nframe,inctim
      m=m+1
      area(n,np+1)=exp(area(n,1))
      area(n,1)=1
      do6i=2,np+1
    6 rcstor(i-1,m)=-(area(n,i-1)-area(n,i))/(area(n,i-
      1)+area(n,i))
   10 continue
      nspfr=m
c+++    930 c+++   Synthesize Speech
      rewind 21
      call zero(fmem,16)
      sp0=0
      do300m=1,nspfr
      read(20,end=500)exc
      do30n=1,80
      wps=rcstor(np,m)*fmem(1)+exc(n)
      do3k=2,np
      wps=wps+rcstor(np+1-k,m)*fmem(k)
    3 fmem(k-1)=fmem(k)-rcstor(np+1-k,m)*wps
      fmem(np)=-wps
      sp(n)=wps+gamma*sp0
   30 sp0=sp(n)
      write(21)sp
  300 continue
  500 endfile 21
      stop
      end
cHAMING Haming Window
      Subroutine HAMING (x,lx)
      dimension x(1)
      data lxp/0/
      if(lx.eq.lxp)goto100
      c1=cos(2.0*3.14159254/float(lx))
      c1p=c1
  100 lxp=lx
      c1=c1p
      a=2.0*c1
      c0=a*c1-1.0
      do1n=1,lx
      c2=a*c1-c0
      x(n)=x(n)*(0.54-0.46*c2)
      c0=c1
    1 c1=c2
      return
      end
cINTRPL Interpolate
      Subroutine INTRPL (x,lx,y,ly,h,lh,ld,b)
      dimension x(lx),y(ly),h(lh),b(lh)
      k=0
```

-continued

APPENDIX F

```
      xld=ld
      do1n=1,ly,ld
      k=k+1
      xk=xld*x(k)
      do2i=1,lh-1
    2 b(i)=b(i+1)+xk*h(i)
      b(lh)=xk*h(lh)
      call scopy(ld,b,y(n))
      call scopy(lh,b(ld),b)
    1 continue
      return
      end
cSCOPY Copy A to B
      Subroutine SCOPY (n,x,y)
      real x(n),y(n)
      do1i=1,n
    1 y(i)=x(i)
      return
      end
cZERO Zero An Array
      Subroutine ZERO (x,n)
      real x(n)
      do1i=1,n
    1 x(i)=0.0
      return
      end
```

What is claimed is:

1. A method for compressing speech patterns including the steps of:

analyzing a speech pattern to derive a set of signals ($y_i(n)$) representative of acoustic features of the speech pattern at a first rate, and generating a sequence of coded signals representative of said speech pattern in response to said set of acoustic feature signals at a second rate less than said first rate, characterized in that the generating step includes:

generating a sequence of signals ($\phi_k(n)$) each representative of an individual sound of said speech pattern, each being a linear combination of said acoustic feature signals; determining the time frames of the speech pattern at which the centroids of individual sounds occur in response to said set of acoustic feature signals; generating a sequence of individual sound feature signals ($\phi_{L(l)}(n)$) jointly responsive to said acoustic feature signals and said centroid time frame determination; generating a set of individual sound representative signal combining coefficients ($a_{ik}$) jointly responsive to said individual sound representative signals and said acoustic feature signals; and forming said coded signals responsive to said sequence of individual sound feature signals and said combining coefficients.

2. A method for compressing speech patterns, as claimed in claim 1, wherein the step of determining the time frames of the speech pattern at which the centroids of individual sounds occur comprises producing a signal (v(L)) representative of the timing of the individual sounds in said speech pattern responsive to the acoustic feature signals of the speech pattern, and detecting each negative going zero crossing in said individual sound timing signal.

3. A method for compressing speech patterns as claimed in claim 1 wherein said coded signal forming step comprises generating a signal representative of the bandwidth of each speech representative signal; sampling said speech event feature signal at a rate corresponding to its bandwidth representative signal; coding each sampled speech event feature signal; and producing a sequence of encoded speech event feature signals at a rate corresponding to the rate of occurrence of speech events in said speech pattern.

4. A method for compressing speech patterns as claimed in any one of the preceding claims wherein, said acoustic feature signals are, or are derived from, linear predictive parameter signals representative of the speech pattern.

5. A method for compressing speech patterns as claimed in claim 4 wherein said acoustic feature signals are log area parameter signals derived from the linear predictive parameter signals.

6. A method for compressing speech patterns as claimed in claim 4 wherein said acoustic feature signals are partial autocorrelation signals representative of the speech pattern.

7. Apparatus for compressing speech patterns, including means for analyzing a speech pattern to derive a set of signals representative of acoustic features of the speech pattern at a first rate, and means for generating a sequence of coded signals representative of said speech pattern in response to said set of acoustic feature signals at a second rate less that said first rate, characterized in that the generating means includes:

means for generating a sequence of signals ($\phi_k(n)$) each representative of an individual sound of said speech pattern, each being a linear combination of said acoustic feature signals and determining the time frames of the speech pattern at which the centroids of individual sounds occur in response to said set of acoustic feature signals, means for generating a set of individual sound representative signal combining coefficients ($a_{ik}$) jointly responsive to said individual sound representative signals and said acoustic feature signals, means for generating a sequence of individual sound feature signals ($\phi_{L(I)}(n)$) jointly responsive to said acoustic feature signals and said centroid time frame determination, and means for forming said coded signals responsive to said sequence of individual sound feature signals and said combining coefficients.

8. Apparatus for compressing speech patterns as claimed in claim 7, wherein the means for determining the time frames of the speech pattern at which the centroids of individual sounds occur comprises means for producing a signal representative of the timing of the individual sounds in said speech pattern responsive to the acoustic feature signals of the speech pattern, and detecting each negative-going zero crossing in said individual sound timing signal.

9. Apparatus for compressing speech patterns as claimed in claim 7, wherein the means for forming a signal comprises means for generating a signal representative of the bandwidth of each speech representative signal; means for sampling each individual sound representative signal in said speech pattern at a rate corresponding to its bandwidth representative signal; means for coding each sampled individual sound representative signal; and means for producing a sequence of such encoded individual sound representative signals at a rate corresponding to the rate of occurrence of individual sounds in said speech pattern.

10. Apparatus as claimed in any of claims 7 to 9, wherein the means for analyzing a speech pattern comprises means for generating a set of linear predictive parameter signals representative of the acoustic features of the speech pattern.

11. Apparatus as claimed in any of claims 7 to 9 including means for generating a speech pattern from the coded signal.

* * * * *